US012351974B2

(12) United States Patent
Corens et al.

(10) Patent No.: US 12,351,974 B2
(45) Date of Patent: Jul. 8, 2025

(54) AUTONOMOUSLY DRY-CLEANING A GARMENT WITHIN A KIOSK

(71) Applicant: LaundrySucks.io Inc., Sandy Springs, GA (US)

(72) Inventors: Thibault Corens, Roswell, GA (US); Nishant Jain, Roswell, GA (US); Felicity Alban, Roswell, GA (US)

(73) Assignee: LaundrySucks.io Inc., Sandy Springs, GA (US)

( * ) Notice: Subject to any disclaimer, the term of this patent is extended or adjusted under 35 U.S.C. 154(b) by 0 days.

(21) Appl. No.: 18/582,637

(22) Filed: Feb. 20, 2024

(65) Prior Publication Data

US 2024/0279866 A1 Aug. 22, 2024

Related U.S. Application Data

(60) Provisional application No. 63/446,765, filed on Feb. 17, 2023.

(51) Int. Cl.
*D06F 43/00* (2006.01)
*D06F 34/18* (2020.01)
(Continued)

(52) U.S. Cl.
CPC ..... *D06F 43/007* (2013.01); *D06F 43/005* (2013.01); *D06F 58/203* (2013.01);
(Continued)

(58) Field of Classification Search
CPC .... D06F 43/005; D06F 43/007; D06F 58/203; D06F 2101/12; D06F 2105/20; D06F 2101/16; D06F 2105/40; D06F 2105/56; D06F 2105/00; D06F 2101/18; D06F 2105/22; D06F 2103/64; D06F 2103/06; D06F 73/02
See application file for complete search history.

(56) References Cited

U.S. PATENT DOCUMENTS 3,583,610 A * 6/1971 Forse ..... D06F 73/00 223/74
3,707,855 A * 1/1973 Buckley ..... D06F 87/00 68/6
(Continued)

*Primary Examiner* — Benjamin L Osterhout
(74) *Attorney, Agent, or Firm* — Run8 Patent Group, LLC; Peter Miller

(57) ABSTRACT

One variation of a method for autonomously processing a garment within a kiosk includes: accessing a set of garment characteristics of the garment, the set of garment characteristics including a garment type and a fabric type; based on the set of garment characteristics, selecting a target processing temperature, a target processing humidity, and a set of steam-processing parameters including a steam nozzle path and a steam nozzle speed. This variation of the method also includes: heating air within the kiosk toward the target processing temperature; injecting steam into the kiosk to drive humidity within the chamber toward the target processing humidity; articulating a steam nozzle along the steam nozzle path at the steam nozzle speed to impinge a steam jet across an interior surface of the garment, tension local areas of the garment against the steam jet, and heat local areas of the garment above the transition temperature.

20 Claims, 6 Drawing Sheets

(51) Int. Cl.

| | |
|---|---|
| ***D06F 39/00*** | (2024.01) |
| ***D06F 58/10*** | (2006.01) |
| ***D06F 58/20*** | (2006.01) |
| ***D06F 73/02*** | (2006.01) |
| *D06F 101/12* | (2020.01) |
| *D06F 101/16* | (2020.01) |
| *D06F 101/18* | (2020.01) |
| *D06F 103/06* | (2020.01) |
| *D06F 103/64* | (2020.01) |
| *D06F 105/00* | (2020.01) |
| *D06F 105/20* | (2020.01) |
| *D06F 105/22* | (2020.01) |
| *D06F 105/40* | (2020.01) |
| *D06F 105/56* | (2020.01) |

(52) U.S. Cl.
CPC ..... *D06F 73/02* (2013.01); *D06F 2101/12* (2020.02); *D06F 2101/16* (2020.02); *D06F 2101/18* (2020.02); *D06F 2103/06* (2020.02); *D06F 2103/64* (2020.02); *D06F 2105/00* (2020.02); *D06F 2105/20* (2020.02); *D06F 2105/22* (2020.02); *D06F 2105/40* (2020.02); *D06F 2105/56* (2020.02)

(56) References Cited

U.S. PATENT DOCUMENTS

| | | | | | |
|---|---|---|---|---|---|
| 4,728,015 | A * | 3/1988 | Holzapfel | D06F 73/00 | 223/70 |
| 4,980,981 | A * | 1/1991 | Naidoo | D06F 69/00 | 38/144 |
| 5,305,484 | A * | 4/1994 | Fitzpatrick | D06F 73/02 | 68/6 |
| 5,609,047 | A * | 3/1997 | Hellman, Jr. | D06F 73/00 | 68/222 |
| 5,815,961 | A * | 10/1998 | Estes | D06F 73/02 | 38/14 |
| 8,464,562 | B1 * | 6/2013 | Colburn | D06F 73/02 | 68/222 |
| 12,209,352 | B2 * | 1/2025 | Jain | D06F 34/18 | |
| 12,227,894 | B2 * | 2/2025 | Roh | D06L 1/20 | |
| 2004/0112095 | A1 * | 6/2004 | Bolduan | D06F 17/04 | 68/184 |
| 2005/0115120 | A1 * | 6/2005 | Cevik | D06F 73/02 | 38/14 |
| 2005/0132761 | A1 * | 6/2005 | Carrubba | D06F 73/00 | 68/222 |
| 2007/0006484 | A1 * | 1/2007 | Moschuetz | D06F 58/203 | 34/597 |
| 2008/0217364 | A1 * | 9/2008 | Fong | D06F 59/02 | 223/89 |
| 2008/0256989 | A1 * | 10/2008 | Jeong | D06F 73/02 | 392/441 |
| 2010/0012689 | A1 * | 1/2010 | Guffey | A47G 25/20 | 223/66 |
| 2010/0251779 | A1 * | 10/2010 | Zaglio | D06F 17/04 | 68/13 R |
| 2011/0030249 | A1 * | 2/2011 | Rosenzweig | D06F 73/00 | 38/144 |
| 2012/0018461 | A1 * | 1/2012 | Azizian | D06F 73/02 | 223/66 |
| 2012/0159806 | A1 * | 6/2012 | Dana | D06F 58/203 | 68/6 |
| 2012/0317729 | A1 * | 12/2012 | Song | D06F 58/10 | 68/6 |
| 2013/0193171 | A1 * | 8/2013 | Carter | D06F 75/12 | 68/5 R |
| 2014/0223973 | A1 * | 8/2014 | Alrefaei | A47G 25/14 | 223/51 |
| 2016/0215440 | A1 * | 7/2016 | Burger | D06F 73/02 | |
| 2017/0083885 | A1 * | 3/2017 | Khadgi | G07F 17/20 | |
| 2017/0268156 | A1 * | 9/2017 | Dana | D06F 59/02 | |
| 2019/0257024 | A1 * | 8/2019 | Shin | A61L 9/03 | |
| 2020/0096954 | A1 * | 3/2020 | Kim | H04N 23/611 | |
| 2020/0370236 | A1 * | 11/2020 | Chae | D06F 73/00 | |
| 2021/0032797 | A1 * | 2/2021 | Shin | D06F 67/005 | |
| 2021/0062404 | A1 * | 3/2021 | Ham | D06F 71/34 | |

* cited by examiner

AUTONOMOUSLY DRY-CLEANING A GARMENT WITHIN A KIOSK

CROSS-REFERENCE TO RELATED APPLICATIONS

This Application claims the benefit of U.S. Provisional Application No. 63/446,765, filed on 17 Feb. 2023, which is incorporated in its entirety by this reference.

This Application is related to U.S. patent application Ser. No. 17/632,709, filed on 3 Feb. 2022 and U.S. patent application Ser. No. 17/258,531, filed on 7 Jan. 2021, both of which are incorporated in their entireties by this reference.

TECHNICAL FIELD

This invention relates generally to the field of dry cleaning and more specifically to a new and useful method for autonomously dry-cleaning a garment within a kiosk in the field of dry cleaning.

DESCRIPTION OF THE EMBODIMENTS

Figure 1:
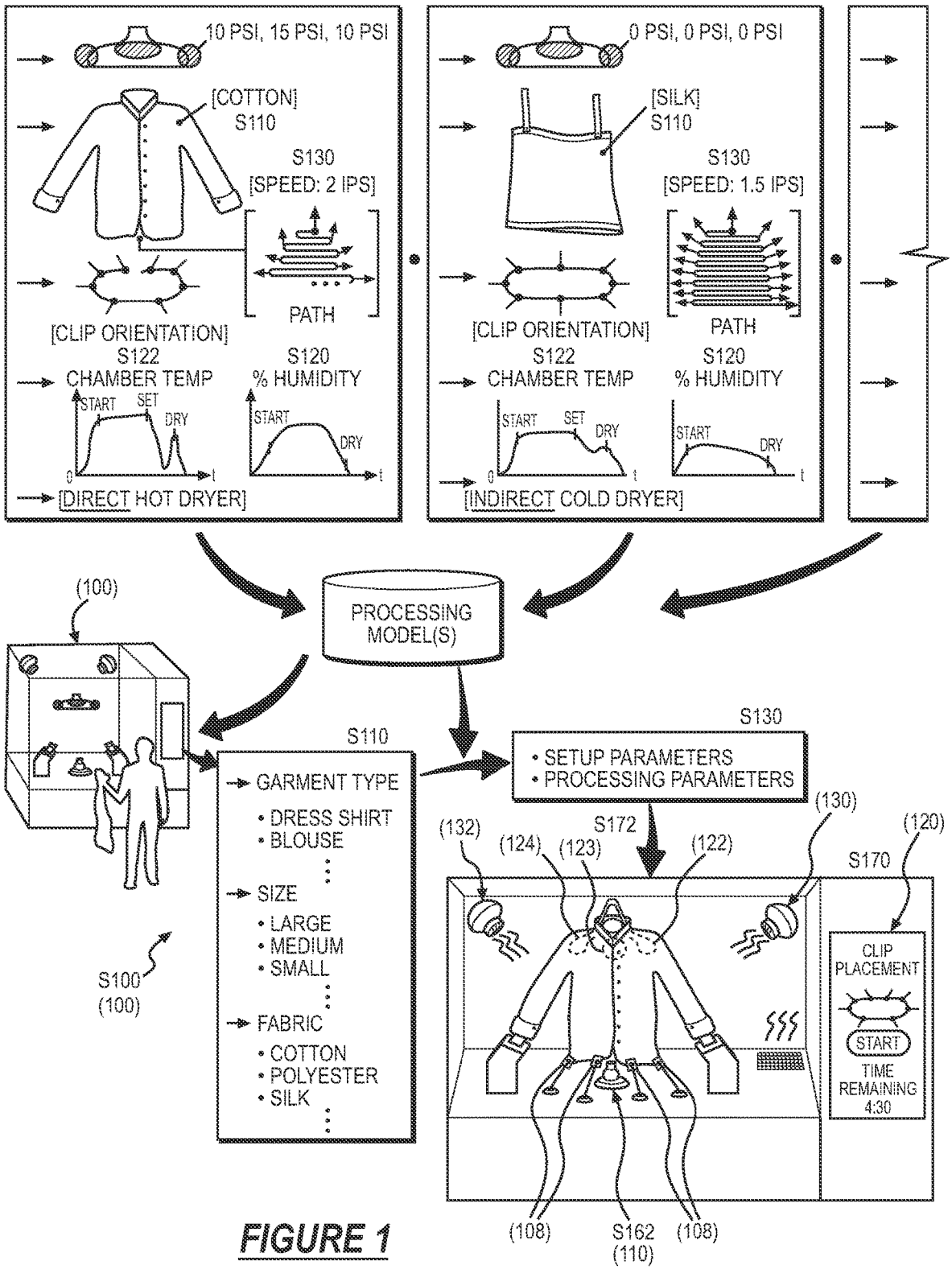
FIG. 1 is a flowchart representation of a method.
Figure 2:
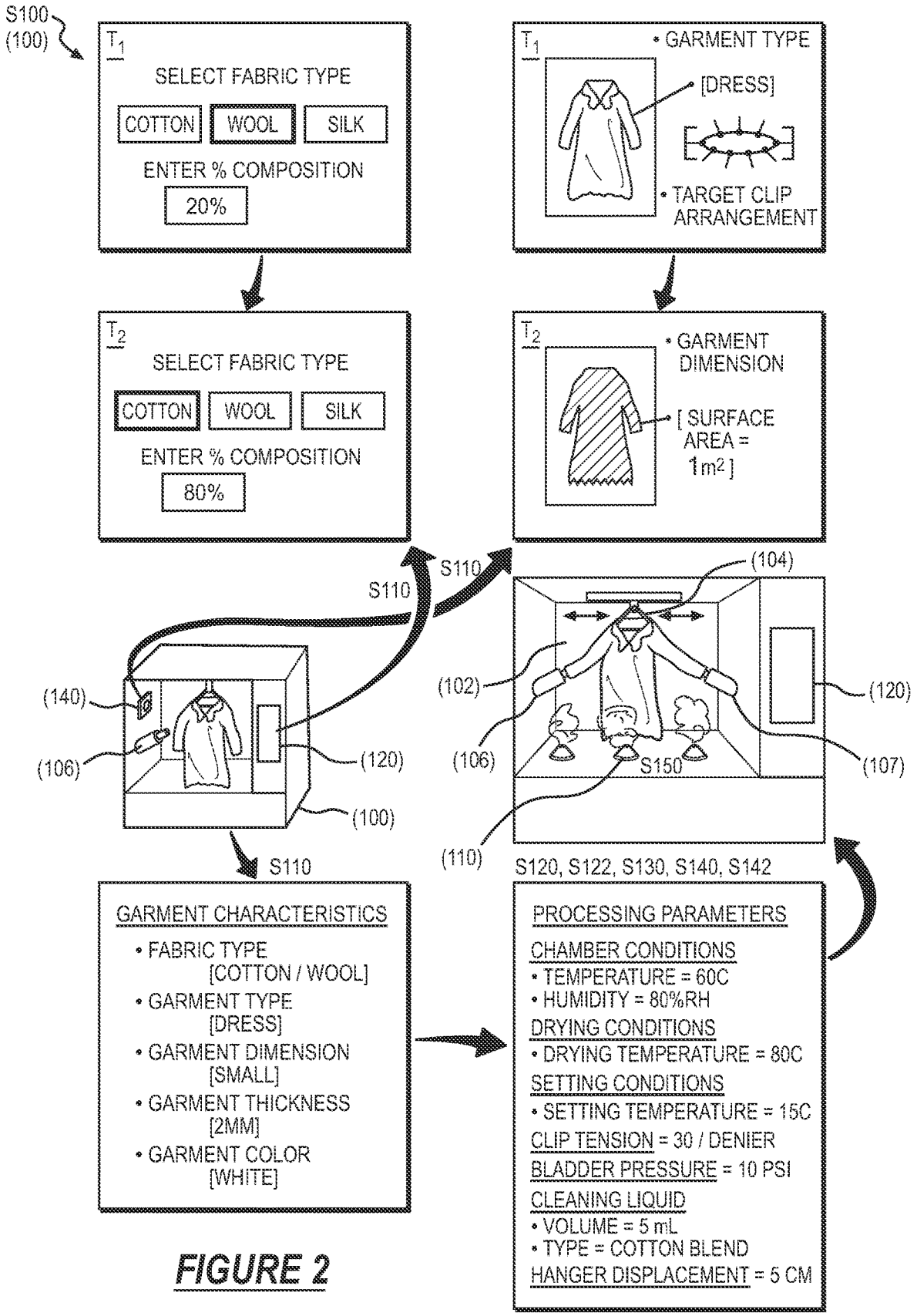
FIG. 2 is a flowchart representation of one variation of the method.

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Method

As shown in FIGS. 1-2 and 4-5, a method S100 for autonomously processing a garment within a kiosk includes: accessing a set of garment characteristics of the garment arranged within a chamber of the kiosk, the set of garment characteristics including a fabric type, a garment type, and a garment dimension in Block S110; selecting a target processing humidity associated with the fabric type in Block S120; selecting a target processing temperature exceeding a transition temperature associated with the fabric type in Block S122; and, based on the set of garment characteristics, selecting a set of steam-processing parameters including a steam nozzle path and a steam nozzle speed in Block S130.

The method S100 further includes, during a first time period during a processing cycle: heating air within the chamber toward the target processing temperature in Block S150; and injecting steam into the chamber to drive a humidity within the chamber toward the target processing humidity in Block S152. The method S100 further includes, during a second time period succeeding the first time period, articulating a steam nozzle along the steam nozzle path at the steam nozzle speed to impinge a steam jet across an interior surface of the garment, tension local areas of the garment against the steam jet, and heat local areas of the garment above the transition temperature in Block S162. In addition, the method S100 includes, in response to the humidity within the chamber exceeding the target processing humidity, evacuating humidified air from the chamber in Block S164.

1.1 Variation: Selecting Drying and Setting Parameters

In one variation, the method S100 for autonomously processing a garment within a kiosk includes: accessing a set of garment characteristics of the garment, the set of garment characteristics including a fabric type, a garment type, and a garment dimension in Block S110; selecting a target processing humidity associated with the fabric type in Block S120; and selecting a target processing temperature exceeding a transition temperature associated with the fabric type in Block S122.

The method S100 further includes: based on the target drying duration and the set of garment characteristics, selecting a target drying temperature in Block S140; and, based on the fabric type, selecting a target setting temperature below the target drying temperature and the transition temperature in Block S142.

The method S100 further includes: during a first time period during a processing cycle, heating air within a chamber toward the target processing temperature in Block S150 and injecting steam into the chamber to drive a humidity within the chamber toward the target processing humidity and heat local areas of the garment above the transition temperature associated with the fabric type of the garment in Block S152; during a second time period succeeding the first time period, actuating a hot dryer 130 to propel hot air toward the garment to drive a chamber temperature toward the target drying temperature in Block S170; and, during a third time period succeeding the second time period, actuating the cold dryer 132 to propel cold air toward the garment to drive the chamber temperature toward the target setting temperature in Block S172.

1.2 Variation: Setting Steam-Processing Temperature and Duration

In one variation, a method S100 for autonomously processing a garment within a kiosk includes: accessing a set of garment characteristics of the garment arranged within a chamber of the kiosk, the set of garment characteristics including a fabric type, a garment type, and a garment dimension in Block S110; based on the fabric type, selecting a target processing humidity in Block S120 and selecting a target processing temperature in Block S122; and, based on the set of garment characteristics, selecting a set of steam-processing parameters including a target steam temperature and a target steaming duration in Block S130.

The method S100 further includes, during a first time period during a processing cycle: heating air within the chamber toward the target processing temperature in Block S150 and injecting steam into the chamber to drive a humidity within the chamber toward the target processing humidity in Block S152; during a second time period succeeding the first time period, heating steam in a steam generator 114 toward the target steam temperature in Block S160 and triggering a steam nozzle to expel steam over the target steaming duration to impinge a steam jet across an interior surface of the garment, tension local areas of the garment against the steam jet, and heat local areas of the garment in Block S162.

2. Applications

Generally, the method can be executed autonomously by a dry-cleaning kiosk (hereinafter the "kiosk"): to access characteristics of a garment readied for dry cleaning; to load a processing model based on characteristics of a garment; and to retrieve or derive processing parameters for the garment based on this processing model and the garment characteristics, such as including specifications for how the garment is retained, ambient conditions within the chamber at the start of and/or during a processing cycle to dry clean the garment, and steam jet manipulation that achieves sufficient local temperatures and pressures to release macro and micro wrinkles in the garment. Once the garment is loaded into the kiosk and retained according to this specification (e.g., hung on a hanger and stretched via a set of retractable clips 108 arranged about the torso of the garment), the kiosk further executes these processing parameters autonomously, including: controlling ambient chamber conditions by heating, recirculating, and/or venting air in the chamber; and sweeping a steam nozzle 110—facing into the garment (e.g., located in the bottom of the kiosk and facing upwardly into a body of the garment retained thereover)—according to this specification, thereby locally heating the garment above its transition temperature while locally stretching the garment and thus removing wrinkles from the garment. The kiosk then: cools the garment by circulating cool air into the chamber, thereby setting the garment without wrinkles; and dries the garment by directing dry and/or heated air at the garment.

In particular, application of heat and moisture onto a wrinkled section of fabric may reset hydrogen bonds that form wrinkles in the fabric. Application of tension or pressure on the wrinkled section of fabric—perpendicular to the wrinkles—may thus reset these hydrogen bonds in an unwrinkled state, thereby rendering this section of fabric without wrinkles. Furthermore, different fabric types may require different combinations of heat, moisture, and pressure to fully release wrinkles. For example, a cotton fabric may require a high ratio of moisture to heat in order to reach its transition temperature, and a polyester fabric may require a much lower ratio of moisture to heat but a higher overall temperature to reach its transition temperature. Furthermore, different fabric types may exhibit different moisture-carrying capacities and drying rates. Excess moisture accumulation on a fabric may therefore result in an overly damp or wet fabric that requires more energy for full wrinkle release, more time and energy to dry, and a longer processing cycle time.

Therefore, the system can: locate a garment within a chamber via a hanger and a set of retractable clips 108 that tension the garment against the hanger; and autonomously control application of heat, moisture, and local pressure on regions of the garment during a processing cycle to achieve full wrinkle release across the garment via steam. More specifically, the computer system can autonomously manipulate a steam nozzle 110, selectively activate hot dryer 130 and cold dryer 132*s*, and selectively ventilate the chamber during the processing cycle to achieve heat, moisture, and local pressures within the garment predicted to yield complete wrinkle release across the garment.

2.1 Garment Retention and Local Pressure

As described in U.S. patent application Ser. No. 17/632,709, the kiosk can retain a garment via a hanger and a set of retractable clips 108 that tension the garment against the hanger. However, individual clips arranged on the garment may only retain the bottom edge of the garment and may therefore stretch the garment along a single tension axis. Subsequent application of heat and moisture on the garment may release wrinkles perpendicular to the tension axis of the clip. However, lack of tension perpendicular to the tension axis may result in incomplete release of wrinkles non-parallel to the tension axis.

Individually and in aggregate, a set of retractable clips 108 arranged about the base of a garment loaded into the kiosk may not provide sufficient tension across the garment (i.e., between tension axes of these clips) to release wrinkles non-parallel to these tension axes.

Therefore, the kiosk can sweep a high-flow-rate, high-pressure steam jet across interior surfaces of the garment, thereby locally stretching the garment radially outwardly via jet impingement. In particular, a pressure front from the steam jet impacting a local region of the garment may stretch this local region of the garment out of plane and both parallel and perpendicular to tension axes of nearest clips arranged on the garment, thereby straightening wrinkles in all directions in this local region of the garment, including wrinkles perpendicular to the tension axes of these nearest clips.

Heat and moisture from this steam jet may thus reset hydrogen bonds in this local region of the garment while the steam jet locally stretches the garment against these wrinkles such that these wrinkles fully release.

The kiosk subsequently injects cool, dry air into the chamber, thereby driving the temperature of this local region of the garment below the transition temperature of the fabric and "setting" the garment in a wrinkle-free state. The kiosk then injects hot, dry air into the chamber to dry the garment before releasing the wrinkle-free garment to a user.

2.2 Processing Model

Furthermore, wrinkles may predominantly (or only) release from a fabric when the fabric region is heated above its transition temperature and stretch perpendicular to these wrinkles. The transition temperature of the fabric may be reduced or controlled by introducing humidity to the fabric, but introduction of excess humidity may result in a damp fabric requiring excessive time to dry and reducing efficacy of wrinkle release via heat and pressure. Conversely, application of excess heat and pressure may damage the fabric.

Furthermore, fabric thickness may affect target heat, humidity, and pressure ranges in which wrinkle release occurs without damage to the fabric.

Furthermore, different garment types (e.g., jackets, blouses, pants, shirts) may exhibit different effective containments of heat and moisture within the garment during a processing cycle and different tensioning via clips and steam jet impingement.

Therefore, the kiosk can store and implement processing models defining processing parameters for achieving complete wrinkle release for garments of particular fabric types, garment types, and garment dimensions (e.g., sizes), such as including: target chamber temperatures throughout a processing cycle; target chamber humidities throughout a processing cycle; a steam nozzle path; a steam nozzle speed; a bladder actuation specification (e.g., target internal pressure within select bladders 121); and/or a garment retention specification (e.g., hanger and clip orientation). The kiosk can then autonomously execute processing cycles according to these processing parameters for individual garments loaded into the kiosk.

3. Kiosk

Figure 3:
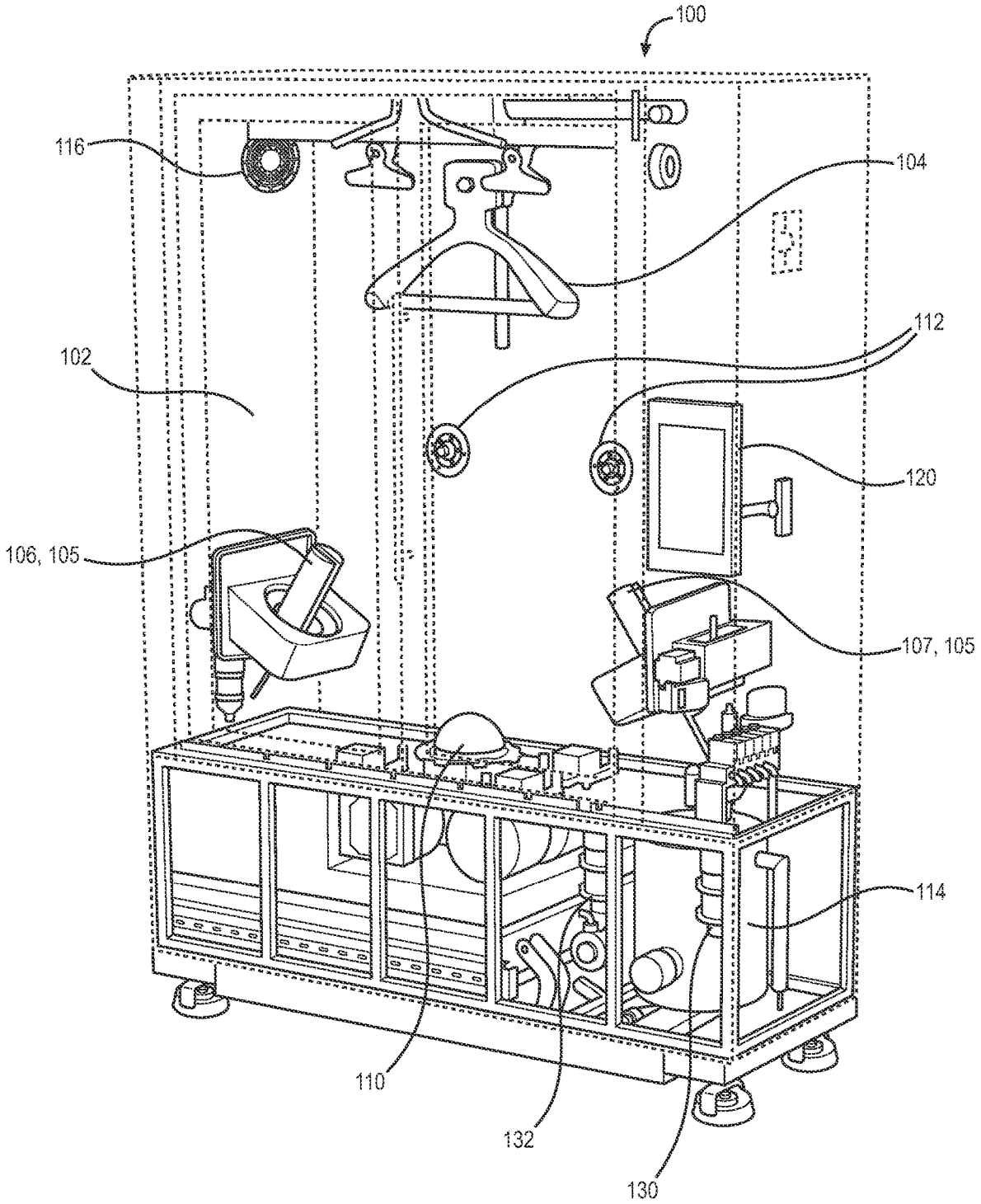
FIG. 3 is a schematic representation of a system.
Figure 4:
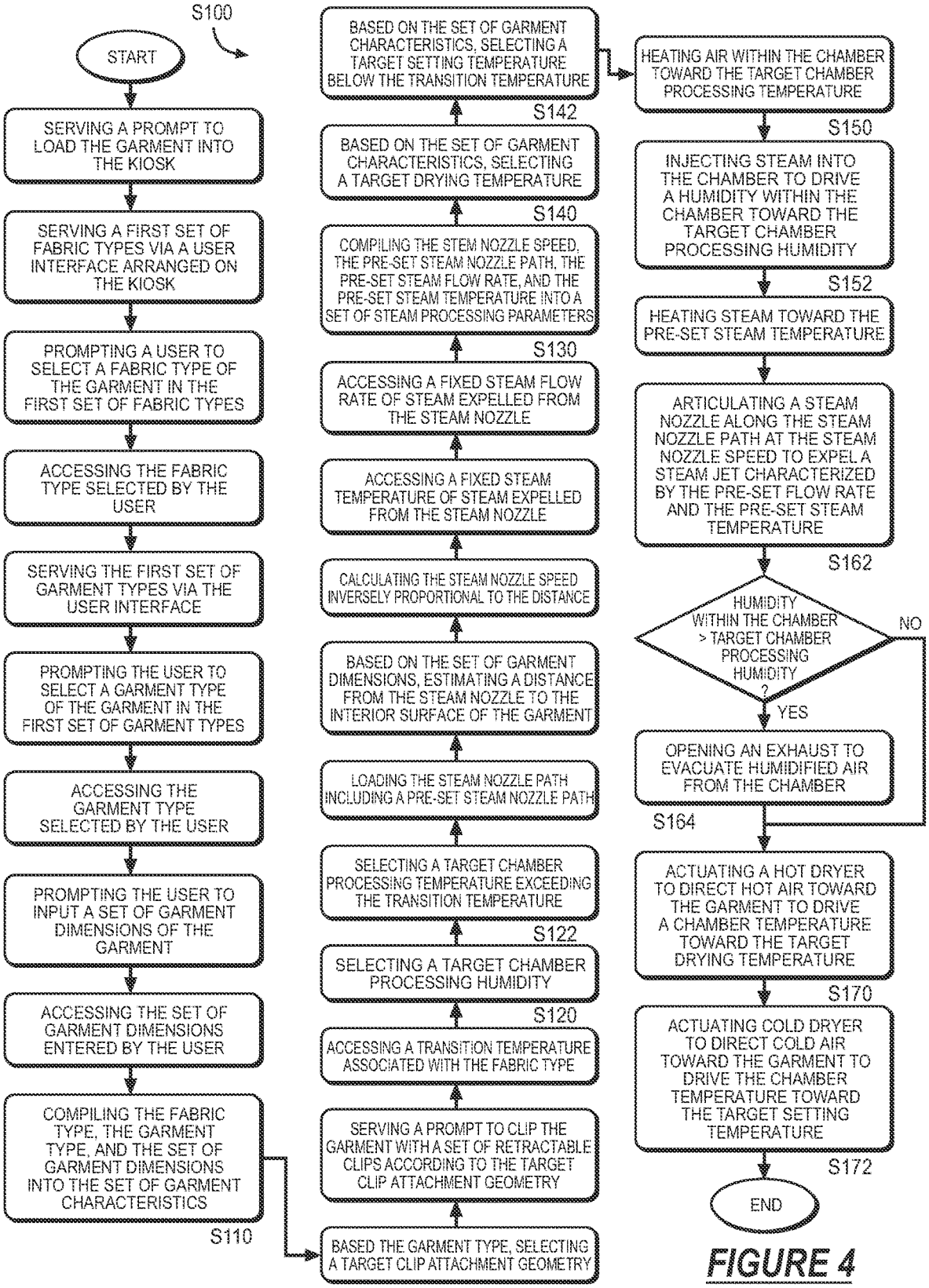
FIG. 4 is a flowchart representation of one variation of the method.
Figure 5:
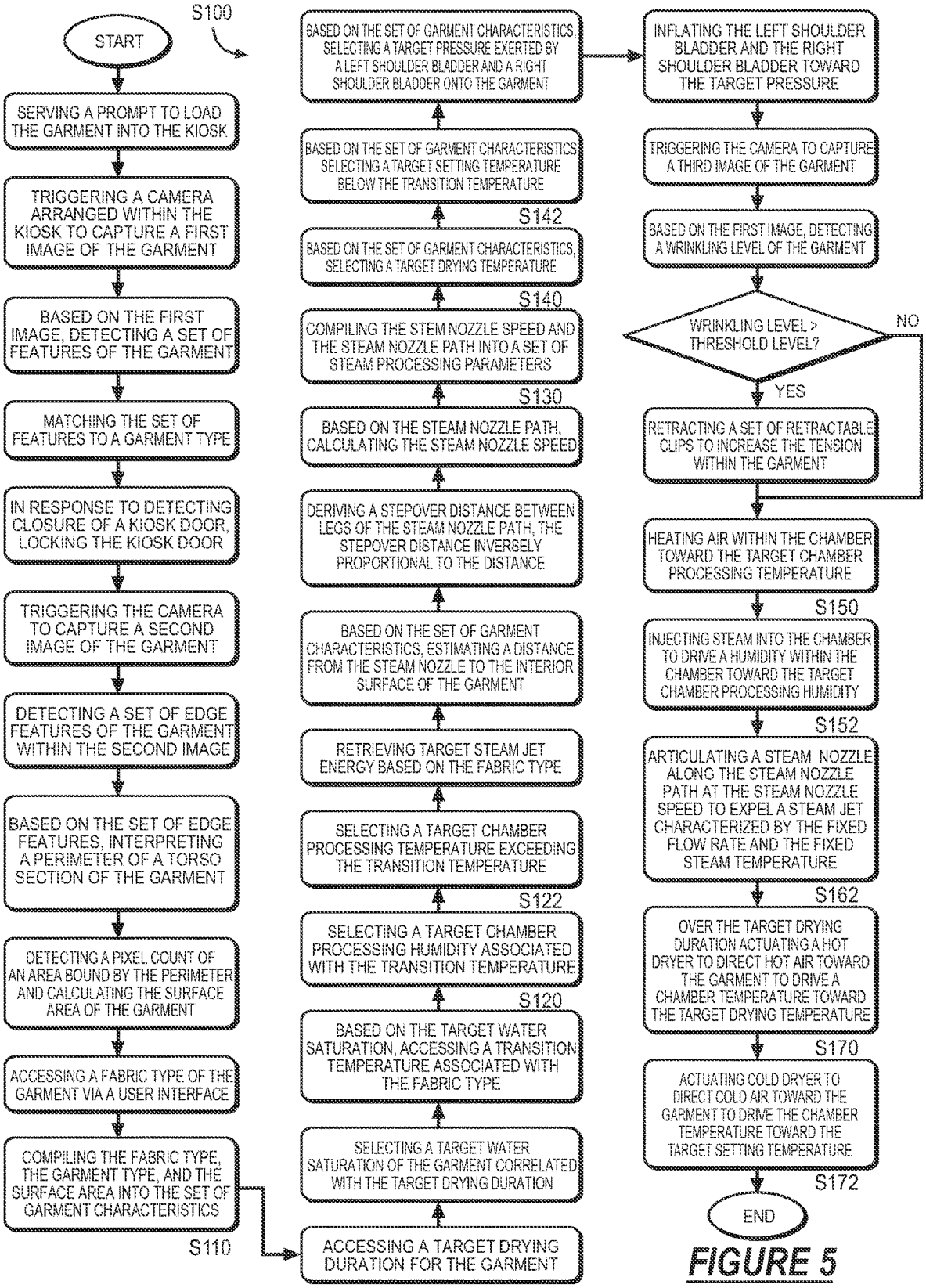
FIG. 5 is a flowchart representation of one variation of the method.

As described in U.S. patent application Ser. No. 17/258,531 and Ser. No. 17/632,709, which are incorporated herein by reference, and shown in FIGS. 3 and 6, the kiosk 100 can include: a housing defining the chamber 102; a hanger 104 arranged in an overhead position within the chamber 102; a left sleeve retainer 107 configured to retain a left sleeve cuff of the garment; a right sleeve retainer 106 configured to retain a right sleeve cuff of the garment; a hot dryer 130 configured to inject heated air into the chamber 102; a cold dryer 132 configured to inject cool (e.g., ambient) air into the chamber 102; a set of dryer nozzles 112 configured to direct heated and cool air from the hot dryer 130 and cold dryer 132, respectively, selectively toward and around the garment; an exhaust 116 (e.g., an outlet) configured to vent air (e.g., moist, heated air) out of the chamber 102; a steam generator 114 configured to heat water into steam; a steam nozzle 110 arranged in the base of the chamber 102 below the camera 104 and configured to expel pressurized steam supplied from the steam generator; and a steam valve configured to selectively release steam from the steam generator 114 to the steam nozzle 110.

The kiosk 100 further includes: an air inlet (or "vent") configured to supply air (e.g., ambient air) to the hot dryer 130 and the cold dryer 132; a fan configured to direct (or "propel") air through the air inlet; a valve configured to selectively direct air from the air inlet to the hot dryer 130 and/or the cold dryer; and a heating element configured to heat air entering, occupying, and/or exiting the hot dryer 130. In one implementation, the heating element includes an electrical (e.g., resistive) heating element configured to convert electrical energy into thermal energy and transfer the thermal energy to the air within the hot dryer 130. In another implementation, the heating element includes a steam-to-air heat exchanger: fluidly coupled to the steam generator 114 via a valve; and configured to transfer heat from the steam-supplied by the steam generator 114—into air passing into, occupying, or exiting the hot dryer 130. Therefore, in this implementation, the steam-to-air heat exchanger can heat air—entering or occupying the chamber 102 of the kiosk 100—with residual heat stored in water contained in the steam generator 114, thereby reducing a temperature of the steam generator 114 following completion of a steaming segment of a processing cycle and reducing energy consumption by the kiosk 100 during a drying segment of the processing cycle.

The kiosk 100 further includes a multi-axis stage configured to manipulate the steam nozzle 110, such as by sweeping in the steam nozzle 110 in a three-dimensional spiral pattern to raster a steam jet from the steam nozzle 110 across interior surfaces of a garment loaded into the kiosk 100.

The kiosk 100 also includes a set of retractable clips 108 arranged below the hanger 104 and configured to: retain a bottom edge of the garment; tension the garment against the hanger 104; and spread the base of the garment outwardly from the steam nozzle 110 arranged below the hanger 104.

The kiosk 100 can further include: a set of bladders 121 arranged in the chamber 102 and selectively expandable to stretch local areas of the garment and to obstruct openings in the garment; an air pump; and a set of pressure valves or pressure regulators configured to selectively expand and retract the set of bladders 121 by distributing air between the air pump and the set of bladders 121. For example, the kiosk 100 can include: a left shoulder bladder 124 arranged on the hanger 104 and configured to expanded into a left shoulder of a garment; a right shoulder bladder 122 arranged on the hanger 104 and configured to expanded into a right shoulder of a garment; a left cuff bladder arranged on the left sleeve retainer 107 and inserted into a left cuff of sleeve of the garment; a right cuff bladder arranged on the right sleeve retainer 106 and inserted into a left cuff of sleeve of the garment; and a neck bladder 123 arranged on the hanger 104 and configured to expand across a neck opening of the garment. When expanded, a bladder can thus trap moisture and heat within the garment. The kiosk 100 can therefore control local temperatures and humidities within the garment during a processing cycle by selectively: expanding a bladder to close the garment opening and thus increase the temperature and humidity inside the garment; and retracting the bladder to unblock the garment opening and thus reduce the temperature and humidity within the garment.

4. Kiosk Controls

Generally, the kiosk 100 can: actuate the hot dryer 130 to increase a global temperature within the chamber 102; actuate the cold dryer 132 and/or the ventilation system to decrease the global temperature and humidity within the chamber 102; actuate the steam nozzle 110 to increase a temperature within the general garment and specifically in locations of steam jet impingement; actuate the steam nozzle 110 to increase pressure—and therefore stretching—in the garment at locations of steam jet impingement; actuate the steam nozzle 110 to increase humidity within the garment and in the chamber 102 more generally; and expand and contract set of bladders 121 to increase and decrease temperature and humidity within the garment.

For example, large garment openings (e.g., neck, arm openings) may enable heat and moisture to escape the garment more rapidly during a processing cycle; and vice versa. The kiosk 100 can therefore selectively expand set of bladders 121 to trap heat and moisture within the garment. Larger garments may yield greater distances between regions of the garment and the steam nozzle 110 and therefore yield reduced temperatures at locations of steam jet impingement on the garment; and vice versa. Higher steam nozzle speeds may yield lower peak temperatures at locations of steam jet impingement; and vice versa. The kiosk 100 can achieve greater local temperatures on the garment and compensate for larger garments by reducing the speed of the steam nozzle 110; and vice versa. Higher ambient temperatures within the chamber 102 may support high ambient humidities in the chamber 102 and enable the kiosk 100 to reach the transition temperature of fabric in a garment—and thus achieve wrinkle release—at higher steam nozzle speeds; and vice versa.

Furthermore, individual input parameters controlled by the kiosk 100 may affect multiple global and local conditions within the chamber 102. For example, activation of the steam nozzle 110 can increase: local temperature and humidity within the garment; chamber humidity; increase local garment pressure; and vice versa. Slower steam nozzle speeds can yield higher: local garment pressures; local garment temperatures; local humidities; and vice versa. Activation of the hot dryer 130 increases a global temperature in the chamber 102 and therefore local temperature in the garment, and activation of the cold dryer 132 decreases a global temperature in the chamber 102 and therefore local temperature in the garment. Expansion of the set of bladders 121 closes garment openings and increases internal garment temperature, internal garment humidity, and internal garment pressure; and vice versa.

The kiosk 100 can thus selectively control these actuators to achieve target temperatures, pressures, and humidities within garments during processing cycles.

5. Processing Model

The kiosk 100 can implement one or a suite of processing models to derive such target temperatures, pressures, and humidities for a garment based on its characteristics. In particular, a processing model can define a set or sequence of processing parameters predicted to yield complete wrinkle release from the garment based on fabric type, garment type, garment dimensions, and/or other characteristics of the garment.

5.1 Fabric Type Effects

Generally, a type and/or thickness of a fabric may require minimum quantities of energy (e.g., heat over time), force or pressure, and/or humidity per unit area to release macro and micro wrinkles within the unit fabric. This fabric type and/or thickness may be exposed to a maximum: amount of humidity per unit area before the fabric becomes saturated or damp (i.e., is perceived as "wet" by a user); heat or temperature before the fabric is damaged (e.g., burned); and/or pressure or force before fabric is damaged (e.g., inelastically stretched). Furthermore, this fabric type and/or thickness may require direct or indirect cooling, a minimum cooling rate, and/or a minimum cooling magnitude to set the fabric without wrinkles after steaming such that wrinkles do not return to the fabric once removed from the kiosk 100 upon conclusion of the processing cycle.

For example, cotton may require greater minimum humidity to release wrinkles than polyester. Polyester may require greater minimum temperature to release wrinkles than cotton. Thicker fabrics may require greater minimum pressure to locally stretch and thus release wrinkles than thinner fabrics. Cotton may support greater maximum moisture exposure before saturation and require greater humidity to reduce transition temperature than polyester. Thicker fabrics may support greater maximum moisture capacity than thinner fabrics. Polyester may support greater maximum heat or temperature exposure before damage than cotton. Polyester may support rapid, direct cooling and drying with cool air via the cold dryer 132, and cotton may require slower, indirect cooling and drying with hot air via the hot dryer 130.

Therefore, for a cotton garment, the kiosk 100 can achieve high humidity, moderate temperature, and moderate pressure within the cotton garment during a processing cycle by: disabling the hot dryer 130 to maintain a higher relative chamber humidity and lower chamber temperature; implementing a faster steam nozzle speed to achieve lower local temperatures and pressures within the garment; and implement shorter stepover offsets between segments of the steam nozzle path to achieve greater humidity within the garment.

Conversely, for a polyester garment, the kiosk 100 can achieve low humidity, high temperature, and high pressure within the polyester garment during a processing cycle by: activating the hot dryer 130 to reduce relative chamber humidity and increase chamber temperature; implementing a slower steam nozzle speed to achieve higher local temperatures and pressures within the garment; and implement larger stepover offsets between segments of the steam nozzle path to achieve lower humidity within the garment.

Conversely, for a silk garment, the kiosk 100 can achieve moderate humidity, high temperature, and low pressure within the polyester garment during a processing cycle by: activating the hot dryer 130 to reduce relative chamber humidity and increase chamber temperature; implementing a faster steam nozzle speed to achieve lower local temperatures and pressures within the garment; and implement shorter stepover offsets between segments of the steam nozzle path to achieve higher humidity within the garment.

Therefore, the kiosk 100 can concurrently modulate multiple input parameters for particular garment fabric types in order to achieve target pressures, temperatures, and humidities within garments.

5.2 Garment Type Effects

Furthermore, garment types (e.g., long-sleeved shirt, short-sleeved shirt, sleeveless shirt, pant, skirt, suit jacket, dress) may define different opening dimensions that yield different heat and moisture retention characteristics and therefore require different heat, moisture, and pressure applications for complete wrinkle release.

For example, for a long- and/or short-sleeved shirt with a high neck, the kiosk 100 can selectively close sleeve and neck openings by inflating set of bladders 121 arranged on a hanger 104 supporting the shirt, thereby trapping heat and moisture within the garment. Conversely, for a sleeveless shirt or blouse with a low neck-line, neck and shoulder openings of the garment may be too large to close via these bladders 121. Steam injected into the garment may therefore pass through the garment rather than remain trapped inside the garment, thereby yielding lower temperatures and humidities within the garment for reduced wrinkle release (especially along the top of the garment. Therefore, the kiosk 100 can: implement reduced steam nozzle speeds, reduced stepover offsets between segments of the steam nozzle path, and/or higher chamber temperatures and humidities for sleeveless shirts and blouses than for long- and short-sleeved shirts with high necks; and implement greater steam nozzle speeds, greater stepover offsets between segments of the steam nozzle path, and/or lower chamber temperatures and humidities for long- and short-sleeved shirts with high necks in order to reduce processing cycle time and energy and water consumption.

In this example, for an open-front suit jacket, the open front of the suit jacket may be too large to close via set of bladders 121 arranged on the hanger 104. Accordingly, steam injected into the garment may pass through the front of the garment rather than remain trapped inside the garment, thereby yielding lower temperatures and humidities within the garment, especially along the front of the garment. Therefore, the kiosk 100 can implement reduced steam nozzle speeds and/or reduced stepover offsets between segments of the steam nozzle path when sweeping the steam nozzle 110 across the front of the suit jacket than across the back of the suit jacket in order to achieve similar wrinkle release across the whole garment.

Furthermore, different garment types may support different combinations of clip-attachments and bladder interfaces that yield different garment tensions during processing. For example, when processing a high-neck, long-sleeved shirt: several clips installed along the bottom edge of the shirt tension the shirt downward and outwardly; the left sleeve retainer 107 and the right sleeve retainer 106 draw the sleeves downwardly and outwardly from the hanger 104; and the hanger 104 and set of bladders 121 retain and expand the shoulders of the shirt upwardly and outwardly, thereby achieving consistent tension across the garment. Conversely, when processing a neckless, sleeveless blouse: clips installed along the bottom edge of the blouse tension the blouse downwardly and outwardly; the set of sleeve retainers 105 (e.g., the left sleeve retainer 107 and the right sleeve retainer 106) and the set of bladders 121 are disengaged from the garment; and the hanger 104 retains the top of the blouse, thereby yielding lower total tension and less consistent tension across the blouse, especially proximal the neck of the blouse. In this example, when processing a suit jacket: several clips installed along the bottom edge of the suit jacket tension the suit jacket downward and outwardly; the set of sleeve retainers 105 draw the sleeves downwardly and outwardly; the hanger 104 and bladders 121 retain and expand the shoulders of the suit jacket upwardly and outwardly, but the front of the suit jacket remains open, yielding less consistent tension across the front of the suit jacket than across the back and sides of the suit jacket. Accordingly, the kiosk 100 can raster the steam nozzle 110 at speeds inversely proportional to local tensions in the garment predicted in fields of view of the steam nozzle 110 based on the format of the garment.

Therefore, different garment types may yield different local heat and humidity retention and different tension characteristics within the garment.

5.3 Garment Dimension Effects

Similarly, different garment dimensions (e.g., sizes) may further yield different local heat and humidity retention and different tension characteristics within the garment.

For example, larger garments define internal surfaces further from the steam nozzle 110, define larger internal volumes, and define larger openings. Thus, the steam jet may exhibit less energy (i.e., reduced temperature and pressure) upon reaching an interior surface of the garment, and larger openings in the garment may quickly release steam and humidity from inside the garment. Thus, to maintain temperature, moisture, and pressure within the garment, the kiosk 100 can: actuate the hot dryer 130 to heat the chamber 102 and garment globally; close a chamber 102 vent to retain moisture within the chamber 102; and reduce stepover offer and speed of the steam nozzle 110 while sweeping the steam nozzle 110 across the interior of a larger garment.

5.4 Processing Models

The kiosk 100 can therefore implement a set of processing models that define target chamber temperatures, target chamber humidities, steam nozzle paths, steam nozzle speeds, bladder actuation specifications, and/or garment retention specifications, etc. based on characteristics of garments such that implementing these input parameters yields target temperatures, pressures, and humidities predicted to achieve complete wrinkle release in these garments.

In one implementation, the kiosk 100 stores and implements one non-parameterized processing model for each material type, garment type, and/or garment dimensions combination. For example, a first processing model for a large cotton dress shirt can define setup parameters including bladder actuation (e.g., target internal pressures for each bladder) and a target clip layout on the garment, such as including graphical and/or textual instructions for a user. In this example, the first processing model can also define processing parameters, including: a steam nozzle path (e.g., starting position, ellipsoid-spiral pattern, ending position, stepover offset between turns of the spiral pattern); a steam nozzle speed, such as for individual segments of the steam nozzle path; hot and cold dryer 132 actuation and timing; target chamber temperatures and humidities, such as at key times during a processing cycle; drying parameters, including hot or cold air from the hot or cold dryer 132 and direct or indirect drying; and ventilation settings (e.g., timing for exhausting and recirculate moist air in the chamber 102).

In the foregoing implementation, the kiosk 100 can similarly store and implement individual processing models specific to: small cotton dress shirts; large cotton blouses; small cotton blouses; large silk blouses; small silk blouses; large silk pants; small silk pants; large wool jacket; small wool jacket; large polyester shirts; small polyester shirts; large scarf or kerchief; large cotton dresses; and/or small cotton dresses; etc.

In another implementation, the kiosk 100 stores and implements parameterized processing models for each material type, such as one processing model for each of: cotton; silk; polyester; nylon; linen; wool; rayon; and/or common fabric blends; etc.

In this implementation, a first processing model for cotton can include functions that return setup parameters (e.g., bladder actuation; clip layout and distribution) and processing parameters (e.g., target values or ranges for steam nozzle pattern, steam nozzle speed, quantity of steam raster cycles, hot and cold dryer 132 actuation, target chamber temperatures and humidities) based on: garment size; sizes and locations of openings (or garment type more generally); and material thickness.

However, the kiosk 100 can implement one or more processing models that store associations between garment characteristics and setups and processing parameters—predicted to yield complete wrinkle release—in any other way.

5.5 Garment Profiles

Figure 6:
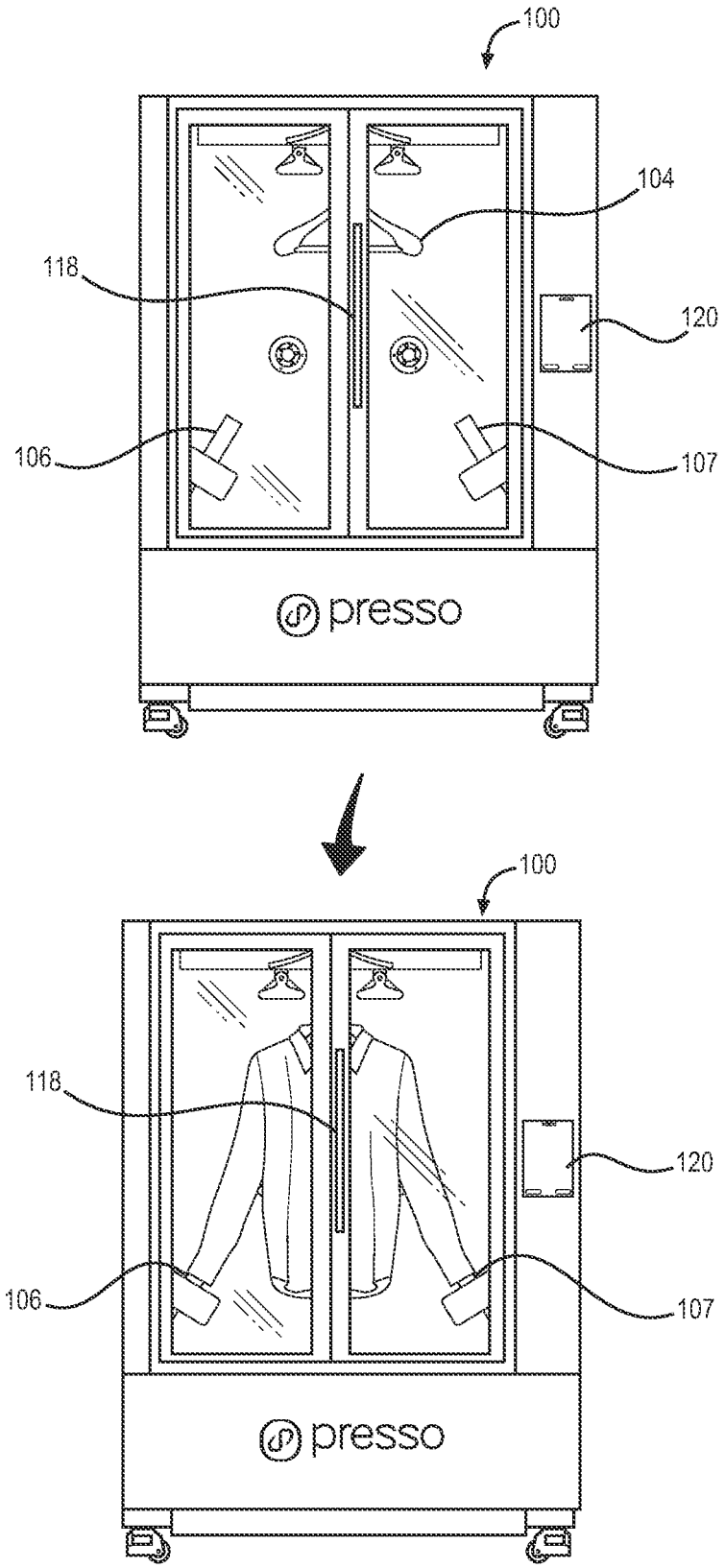
FIG. 6 is a flowchart representation of one variation of the system.

In one implementation, the kiosk 100 can store and execute user-defined processing cycles defining a set of garment processing parameters—such as a target processing temperature, a target steaming duration, a target drying temperature, and/or a type of cleaning liquid—selected by a user for a particular garment or a set of garments. In this implementation, at a first time, the kiosk 100 can: prompt the user to define a user-defined processing cycle by selecting a set of processing parameters from a menu of processing parameters; and store the user-defined processing cycle. Then, at a second time, after receiving a garment, the kiosk 100 can: serve the user a prompt to select a user-defined processing cycle, in a set of stored user-defined processing cycles; and execute the user-defined processing cycle to clean the garment. In another example, the kiosk 100 can: implement methods and techniques described above to select garment processing parameters for a garment, such as once the garment is loaded into the chamber 102, as shown in FIG. 6; present these garment processing parameters to a user via the user interface; prompt the user to confirm or modify these garment processing parameters via the user interface; and then execute these garment processing parameters to steam, clean, and dry the garment once confirmed by the user.

6. Accessing Garment Characteristics

Block S110 of the method S100 recites: accessing a set of garment characteristics of the garment arranged within a chamber 102 of the kiosk 100, the set of garment characteristics including a fabric type, a garment type, and a garment dimension. Generally, in Block S110, the kiosk 100 can retrieve certain characteristics of the garment, which is loaded or is pending loading into the kiosk 100 by a user. In one example, the garment characteristics can include the garment type (e.g., sleeved shirt, pant, sleeveless dress), the fabric type (e.g., cotton, polyester, wool), the garment dimensions (e.g., garment size, weight, surface area), a fabric thickness (e.g., 5 millimeters), a fabric weave (e.g., open weave/lace, satin weave), and/or a fabric color (e.g., white, magenta, multi-color). For example, the kiosk 100 can receive manual selection of a garment type, fabric type, and garment dimensions entered manually by a user via a dropdown menu or image-based garment catalog rendered on a user interface 120 arranged on the kiosk 100. Therefore, prior to receiving or processing the garment, the kiosk 100 can access the garment characteristics of the garment, which will affect the processing parameters implemented by the kiosk 100 while processing the garment.

6.1 Manual Input of Garment Characteristics

In one implementation, the kiosk 100 can access the set of garment characteristics as user input received via a user interface 120 arranged on the kiosk 100 and/or received via a user interface 120 of a mobile application installed on a mobile device of the user, the mobile device communicatively coupled to the kiosk 100. For example, the kiosk 100 can access the fabric type of the garment by presenting a menu of the fabric types to the user via the user interface and accessing the fabric type selected by the user from the fabric type menu. Furthermore, by repeatedly presenting the menu to the user, the kiosk 100 can enable the user to select a partial composition of the fabric type, such as the fabric type including 20% wool and 80% polyester.

In this implementation, the kiosk 100 can: serve a selection menu including a first set of fabric types; prompt the user to select the fabric type of the garment in the first set of fabric types; access a first fabric type, in the set of fabric types, selected by the user; and, in response to accessing the first fabric type, prompt the user to input a first percent composition of the first fabric type in the garment. Then, in response to the first percent composition falling below 100 percent, the kiosk 100: can serve a second set of fabric types, the second set of fabric types excluding the first fabric type; and prompt the user to select a second fabric type of the garment from the second set of fabric types. Then, the kiosk 100 can: access the second fabric type, in the second set of fabric types, selected by the user; in response to accessing the second fabric type, prompt the user to input a second percent composition of the second fabric type in the garment; and, in response to a sum of the first percent composition and the second percent composition approximating 100 percent, storing the first fabric type linked to the first percent composition and the second fabric type linked to the second percent composition as the fabric type of the garment.

The kiosk 100 can similarly access other garment characteristics, such as garment type or garment dimensions, by sequentially serving selection menus to the user via the user interface 120 and accessing the manual selections of the user via the user interface 120.

Therefore, the kiosk 100 can access the set of garment characteristics, such as the fabric type, the garment type, the garment dimensions, the fabric thickness, and the garment color, manually input by the user via the user interface 120. Furthermore, the kiosk 100 can access garment characteristics including combinations of specific fabric types, fabric thicknesses, or garment colors. Accessing the set of garment characteristics enables the kiosk to select a set of processing parameters for steaming, cleaning, and drying the garment.

6.2 Automatic Detection of Garment Characteristics

In one implementation, the kiosk 100 can automatically detect the set of garment characteristics based on images captured by a camera 140 arranged within the chamber 102 of the kiosk 100 or arranged on the side of the kiosk 100. For example, prior to receiving the garment, the kiosk 100 can: detect the garment type of the garment based on an image captured by a first camera arranged on an outer side of the kiosk 100, such as above the kiosk door 118; based on the garment type, retrieve instructions for loading the garment type into the kiosk 100; and serve these instructions to the user. Then, after the garment has been loaded into the kiosk 100, the kiosk 100 can detect the garment dimensions based on a second image captured by a second camera arranged within the chamber 102.

In one implementation, at a first time, the kiosk 100 can: serve a prompt to load the garment into the kiosk 100; trigger a camera 140 arranged within the kiosk 100 to capture a first image of the garment; detect a set of features of the garment in the first image; match the set of features to a template, in a set of templates, linked to the garment type; and, in response to matching the set of features to the template, identify the garment type. For example, in response to detecting the set of features in the first image, such as a collar, a placket, a pair of cuffs, and a set of buttons, the kiosk 100 can identify the garment type as a dress shirt. Then, at a second time, the kiosk 100 can: in response to detecting closure of a kiosk door 118, lock the kiosk door 118 and trigger the camera 140 to capture a second image of the garment; and detect the garment dimension based on the second image.

More specifically, the kiosk 100 can: detect a set of edge features, representing an outline of the garment, in the second image. For example, to detect the set of edge features, the kiosk 100 can apply image processing techniques, such as filtering, gradient calculation, and thresholding, to identify discontinuities in brightness in the second image, the discontinuities corresponding to the set of edge features. Then, based on the set of edge features, the kiosk 100 can: interpret a perimeter of a torso section of the garment based on the set of edge features; detect a pixel count of an area of the second image bound by the perimeter; and calculate the garment dimension comprising a surface area of the torso section of the garment based on the pixel count. The kiosk 100 can further convert the surface area of the garment to a garment size, such as small, medium, or large. Therefore, the kiosk 100 can automatically detect the garment dimensions, such as the surface area or the garment size, based on the pixel count of the garment torso depicted in the image captured by the camera 140.

Therefore, the kiosk 100 can automatically detect the garment characteristics, such as the garment type and the garment dimensions, based on images of the garment captured by one or more cameras arranged on the kiosk 100. By automatically detecting the garment characteristics, the kiosk 100 can forgo accessing manual user input, thereby reducing time duration associated with manual user input of the garment characteristics and eliminating potential for human error, as the user may input incorrect garment characteristics. By reducing the setup time duration and eliminating user involvement in identification of the garment characteristics, the kiosk 100 can improve user experience.

6.3 Generating Loading Instructions

After accessing the manually-selected set of garment characteristics, the kiosk 100 can: serve graphical and/or textual instructions for loading the garment into the kiosk 100, the instructions prompting the user to affix the garment on a hanger 104 arranged within the chamber 102 of the kiosk 100 and/or to install a set of retractable clips 108 on the garment according to a target clip-attachment geometry; and prompt the user to load the garment into the chamber 102 according to the instructions.

In one implementation, the kiosk 100 can access the loading instructions based on the set of garment characteristics. For example, during an idle/standby time period, when the kiosk 100 is not processing any garment, the kiosk 100 can display a trigger, such as a start button, via the user interface 120, for presenting the menu of the set of garment characteristics. After the user presses the start button, the kiosk 100 can: display the menu of the set of garment characteristics; and access the set of garment characteristics manually input by the user. Then, in response to accessing the set of garment characteristics, the kiosk 100 can: unlock a kiosk door 118; based on the garment type, access instructions for loading the garment into the kiosk 100, the instructions including the target clip-attachment geometry for the set of retractable clips 108; and serve the instructions to the user. The user may then follow the instructions to load the garment into the chamber 102 of the kiosk 100 and, after the garment is loaded, close the kiosk door 118. In response to detecting closure of the kiosk door 118, the kiosk 100 may lock the kiosk door 118. Therefore, the kiosk 100 can first retrieve the manual input of the garment characteristics of the garment and then serve instructions, specific to the garment, for garment loading and clip-attachment.

In one implementation, the kiosk 100 can access the loading instructions prior to accessing the set of garment characteristics. In one example, during the idle/standby time period, when the kiosk 100 is not processing the garment, the kiosk 100 can maintain the kiosk door 118 unlocked. Then, the user may open the kiosk door 118 and place the garment on the hanger 104 arranged within the chamber 102 of kiosk 100. In this example, the kiosk 100 can include printed instructions, for loading various garment types, arranged on an outer side of the kiosk. In another example, during the idle time period, the kiosk 100 can serve, via user interface 120, a trigger for presenting generic instructions for loading the garment into the kiosk 100. After the user presses the start button, the kiosk 100 can unlock the kiosk door 118 and serve a prompt to load the garment into the kiosk 100 by hanging the garment on the hanger 104. In response to detecting opening of the kiosk door 118 or in response to detecting the garment inside the chamber 102, the kiosk 100 can trigger the camera 140 to capture an image of the garment arranged within the kiosk 100 and detect the set of garment characteristics based on the image. Then, after accessing the set of garment characteristics, the kiosk 100 can: access specific instructions for installing a set of retractable clips 108 on the garment with the garment type; serve the instructions to the user; and, in response to detecting closure of the kiosk door 118, lock the kiosk door 118. Therefore, the kiosk 100 can: first serve generic instructions for loading any garment into the kiosk; upon detecting a garment inside the chamber, detect the garment characteristics of the garment; and, based on the garment characteristics, access and serve specific instructions for arranging the set of retractable clips 118 on the garment.

In one implementation, after accessing the set of garment characteristics, such as the manually selected garment characteristics, of the garment arranged within the chamber 102, the kiosk 100 can: based on the garment type, select a set of garment retention parameters including a target clip-attachment geometry; and serve a prompt to install the set of retractable clips 108 on the garment according to the target clip-attachment geometry. In one implementation, the target clip-attachment geometry can include a map or a representation of the garment indicating a set of attachment points on the garment for the set of retractable clips 108. For example, the target clip-attachment geometry can include the set of attachment points along a bottom edge of the garment. Therefore, the kiosk 100 can select the target clip-attachment geometry for the garment based on the garment type of the garment, the target clip-attachment geometry configured to evenly tension the garment and create an opening in the garment that allows steam to enter the interior surface of the garment.

7. Selecting Garment Processing Parameters

After accessing the set of garment characteristics, the kiosk 100 can select setup processing parameters for the garment based on the garment characteristics. For example, the kiosk 100 can input the garment type and garment dimensions into the processing model for cotton garments, which then returns specific setup and processing parameters, such as processing temperature, for the garment. Additionally, or alternatively, the kiosk 100 can access these predefined setup and processing parameters from a database or a table linking combinations of various garment characteristics to the processing parameters.

7.1 Selecting Target Processing Temperature and Humidity

Blocks S120 and S122, of the method S100 recite: selecting a target processing humidity associated with the fabric type; and selecting a target processing temperature exceeding a transition temperature associated with the fabric type. Generally, in Blocks S120 and S122, the kiosk 100 can: select the target processing temperature and the target processing humidity parameters that facilitate heating the garment above the transition temperature of the garment during the processing cycle. By heating the garment above the transition temperature of the garment during the processing cycle, the kiosk 100 can trigger transition of the garment fabric from a relatively rigid state to a relatively malleable state, which facilitates removal of wrinkles and creases from the garment fabric. Therefore, based on the fabric type, the kiosk 100 can select the target processing temperature and the target processing humidity parameters that exceed the transition temperature, thereby facilitating wrinkle-release in the garment fabric.

In one implementation, the kiosk 100 can: derive the target processing temperature and processing humidity based on a target water saturation of the garment, the target water saturation representing a fraction or a percentage of a total weight of the garment that is attributable to water or moisture absorbed by the garment fabric. For example, the user may load a dry garment into the kiosk 100, the garment characterized by a moisture saturation below 1%. Then, by increasing ambient humidity within the chamber, applying cleaning liquid to the garment, and steaming the garment, the kiosk 100 can increase the moisture saturation of this garment to 5-20%. Generally, by increasing the water saturation for the garment, the kiosk 100 increases the drying duration for the garment, the drying duration representing a quantity of time to decrease the water saturation of the garment below a certain threshold, such as 1%, thereby drying the garment. Therefore, the kiosk 100 can select the target water saturation for the garment based on a target drying duration.

In this implementation, the kiosk can: access a target drying duration for the garment; select a target water saturation of the garment correlated with the target drying duration; based on the target water saturation, access a transition temperature of the fabric type saturated to the target water saturation; select a target processing humidity predicted to yield the target water saturation of the garment; and select a target processing temperature exceeding the transition temperature. Therefore, to dry the garment within the target drying duration, the kiosk 100 can: select the target processing humidity predicted to yield the target water saturation of the garment. For certain fabric types the transition temperature may vary based on the water saturation of the garment fabric. Thus, the kiosk 100 can: estimate the transition temperature based on the fabric type and the target water saturation; and select the target processing temperature above the transition temperature. Thus, the kiosk 100 can select ambient chamber conditions that facilitate drying the garment within the target drying duration.

In a first example, the kiosk 100 can: access a first fabric type of a first garment, the first fabric type comprising cotton; access a first target water saturation of the garment within a first range between 5% and 10% based on the first fabric type of the garment; calculate the target processing humidity predicted to yield the first target water saturation within the garment resulting from application of the steam jet across the interior surface of the garment according to the set of steam-processing parameters; access the transition temperature, of the fabric type of the garment, in a second range between 50 degrees Celsius and 60 degrees Celsius; and select the target processing temperature exceeding the transition temperature in a third range between 60 degrees Celsius and 70 degrees Celsius.

In a second example, the kiosk 100 can: access a second fabric type of a second garment, the first fabric type comprising silk; access a second target water saturation of the garment within the first range between 5% and 10% based on the second fabric type of the second garment; calculate a second target chamber humidity predicted to yield the second target water saturation within the garment resulting from application of the steam jet across the interior surface of the garment according to the set of steam-processing parameters; access a second transition temperature of the second fabric type of the second garment, in a fourth range between 40 degrees Celsius and 50 degrees Celsius; and select the target processing temperature exceeding the transition temperature in the second range between 50 degrees Celsius and 60 degrees Celsius. Therefore, the kiosk 100 can select different target processing temperature for a silk garment and a cotton garment characterized by the same target water saturation.

7.2 Selecting Target Cleaning Parameters

In one implementation, based on the set of garment characteristics, the kiosk 100 can select a set of cleaning parameters for the garment. In particular, based on the fabric type, the kiosk 100 can select a first cleaning liquid type, in a set of cleaning liquid types, of a cleaning liquid to be applied to the garment. For example, the kiosk 100 can select a particular cleaning liquid formulation that is most suitable for cleaning and deodorizing a particular fabric type. In another example, in response to the set of garment characteristics indicating that the garment is characterized by a vibrant color, the kiosk 100 can select a cleaning liquid type formulated to preserve vibrancy of the fabric color. In addition, the kiosk 100 can: map the garment dimensions to a garment size of the garment; and select a target cleaning liquid volume of the cleaning liquid to be applied to the garment, the target cleaning liquid volume directly correlated with the garment size. For example, the kiosk 100 can select a first cleaning liquid volume in response to the garment size corresponding to "small" and select a second cleaning liquid volume, exceeding the first cleaning liquid volume, in response to the garment size corresponding to "large". Therefore, based on the set of garment characteristics, the kiosk 100 can select the set of cleaning parameters configured to enable the kiosk 100: to deliver the target cleaning liquid amount to the garment without oversaturating the garment with the cleaning liquid; and to apply the cleaning liquid type to the garment that is configured to minimize chemical damage to the garment while simultaneously removing impurities and deodorizing the garment.

7.3 Selecting Target Steam-Processing Parameters

Block S130 of the method S100 recites: based on the set of garment characteristics, selecting a set of steam-processing parameters including a steam nozzle path a steam nozzle speed. Generally, in Block S130, the kiosk 100 can select the steam nozzle path of the steam nozzle 110 to be executed on the garment and the steam nozzle speed of the steam nozzle 110 or the garment. More specifically, during the processing cycle, the kiosk 100 can articulate the steam nozzle 110 though the steam nozzle path the steam nozzle speed to: impinge a steam jet across an interior surface of the garment; saturate local areas of the garment with steam; tension the local areas of the garment with steam; increase the temperature of the local areas of the garment. Therefore, based on the garment characteristics, the kiosk 100 can select the set of processing parameters, such as the steam nozzle path and the steam nozzle speed, that facilitate wrinkle-release in the garment though application of steam to the garment though the steam nozzle 110. Furthermore, the kiosk 100 can select the set of processing parameters that enable the kiosk 100 to avoid overheating, overwetting, permanently stretching, or otherwise damaging the garment during the application of steam though the steam nozzle 110.

In one implementation, based on the set of garment characteristics, the kiosk 100 can select a set of steam-processing parameters including a target steam temperature and a target steaming duration. More specifically, based on the fabric type, the garment dimension, and the garment type, the kiosk 100 can: select the target steam temperature of steam released by the steam nozzle 110, the steam configured to heat the garment above the transition temperature given the target processing temperature; and select the target steaming duration of steam release via the steam nozzle 110, the steaming duration configured to facilitate saturating the garment with moisture to the target water saturation given the target processing humidity. Therefore, the kiosk 100 can select the set of steam-processing parameters including the target steam temperature and the target steaming duration, which enable the kiosk 100 to heat the garment above the transition temperature and saturate the garment to the target water saturation during the processing cycle given the temperature and humidity conditions inside the chamber 102. By heating the garment above the transition temperature and saturating the garment to the target water saturation, the kiosk 100 can: decrease wrinkling and creasing of the garment fabric; remove dirt and excess cleaning liquid; and deodorize and clean the garment.

In one implementation, the kiosk 100 can execute a steam nozzle path on the garment such as by articulating the steam nozzle 110 along the steam nozzle path at the steam nozzle speed to impinge a steam jet across an interior surface of the garment. In one example, the kiosk 100 can robotically guide the steam nozzle 110 though the steam nozzle path at a certain distance from the interior or exterior surface of the garment. In another example, the kiosk 100 can rotate a stationary steam nozzle 110 at the nozzle speed (e.g., rotational speed) to deliver the steam to the interior or exterior surface of the garment in a pattern corresponding to the steam nozzle path.

In one implementation, the kiosk 100 can: select a single, pre-set (e.g., fixed) steam nozzle path for all garments, the predefined steam nozzle path linked to a nominal steam temperature and a nominal steam flow rate. Then, the kiosk 100 can derive a variable steam nozzle speed for the predefined steam nozzle path based on the garment characteristics. In this implementation, the kiosk 100 can: load the predefined steam nozzle path; access the nominal steam temperature of steam expelled from the steam nozzle 110; and access the nominal steam flow rate of steam expelled from the steam nozzle 110. Then, based on the predefined steam nozzle path and the garment characteristics, such as the garment dimensions and the garment type, the kiosk 100 can estimate a distance from the steam nozzle 110 to the interior surface of the garment. Then, the kiosk 100 can calculate the steam nozzle speed, which is inversely proportional to the distance. Generally, the greater the distance from the steam nozzle 110 to the interior surface of the garment, the lower the intensity, or volume of steam per unit area, of the steam reaching the garment. However, by articulating the steam nozzle 110 at a reduced speed, the kiosk 100 can increase the steam volume per unit area delivered to the garment. Thus, to deliver a constant steam volume per unit area to the garment via the steam nozzle 110 given variable distance between each garment and the steam nozzle 110, the kiosk 100 can: calculate a first (e.g., higher) steam nozzle 110 speed in response to detecting a first (e.g., shorter) distance from the steam nozzle 110 to the garment; or calculate a second (e.g., decreased) steam nozzle speed, falling below the first steam nozzle speed, in response to detecting a second distance exceeding the first distance, from the steam nozzle 110 to the garment. Therefore, the kiosk 100 can calculate a variable steam nozzle speed for the predefined steam nozzle path, which enables the kiosk 100 to deliver the target steam volume per unit area to the interior surface of the garment given the distance between the steam nozzle 110 and the garment. By calculating the steam nozzle speed that enables the kiosk 100 to deliver the target volume of steam per unit area to the garment, the kiosk 100 can select the set of steam-processing parameters that facilitate wrinkle release, cleaning, and deodorizing of the garment.

In one implementation, the kiosk 100 can derive a target steam nozzle path for the garment based on the garment characteristics. In this implementation, the kiosk 100 can: select a target steam jet energy (or force or intensity) based on the fabric type. For example, the kiosk 100 can: select a first (e.g., high) steam jet energy for coarse, heavy, or thick fabric types, such as canvas or felt; and select a second (e.g., low) steam jet energy for delicate fabric types, such as silk, the second steam jet energy less than the first steam jet energy. Then, the kiosk 100 can: estimate a distance from the steam nozzle 110 to the interior surface of the garment based on the garment dimensions; and derive a stepover distance between legs of the steam nozzle path, the stepover distance inversely proportional to the distance. Generally, greater distances from the steam nozzle 110 to the interior surface of the garment are correlated with lower steam jet energies of the steam jet reaching the garment. However, by selecting a shorter stepover distance, the kiosk 100 can increase the steam jet energy delivered to a unit area of the garment. Thus, to deliver the target steam jet energy per unit area to the garment via the steam nozzle 110, the kiosk 100 can: select a first stepover distance in response to detecting a first distance to the interior surface of the garment; or select second stepover distance, falling below the first stepover distance, in response to detecting a second (e.g., longer) distance, exceeding the first distance, to the interior surface of the garment. The kiosk 100 can: based on the stepover distance, define the steam nozzle path characterized by the stepover distance; and, based on the steam nozzle path, calculate the steam nozzle speed, a steam temperature, and a steam flow rate predicted to yield an estimated energy of the steam jet, directed by the steam nozzle 110 along the steam nozzle path and impinging on the interior surface of the garment, that approximates the target steam jet energy. Therefore, the kiosk 100 can define the steam nozzle path for the garment given the set of garment characteristics, the steam nozzle path configured to deliver the target steam jet energy to the interior surface of the garment given the distance between the steam nozzle 110 and the garment, which is based on the garment dimensions. By deriving the steam nozzle path, the kiosk 100 can select the set of steam-processing parameters that facilitate wrinkle release, cleaning, and deodorizing of the garment.

7.4 Selecting Target Drying and Setting Parameters

Blocks S140 and Block S142 of the method S100 recite: based on the set of garment characteristics, selecting a target drying temperature; and, based on the fabric type, selecting a target setting temperature below the target drying temperature and the transition temperature. Generally, in Blocks S140 and S142, the kiosk 100 can select the temperature parameters that facilitate moisture removal from the garment and increasing rigidity of the garment fabric. Therefore, based on the garment characteristics, the kiosk 100 can select the target drying temperature and the target setting temperature configured to return the garment to a cool and dry state, thereby preparing the garment for handling and wear by the user.

In one implementation, based on the set of garment characteristics, the kiosk 100 can select a set of drying and setting parameters for drying and setting the garment prior to termination of the processing cycle. More specifically, based on the set of garment characteristics, the kiosk 100 can select a target drying temperature. For example, for garments with dense fabric types or large sizes, the kiosk 100 can select a higher drying temperature than for garments with thin, delicate fabric types or small sizes. The kiosk 100 can then access a target drying humidity, which can be the same for all garments or can be based on the set of garment characteristics. For example, for garments with dense fabric types or large sizes, the kiosk 100 can select a lower drying humidity than for garments with thin, delicate fabric types or small sizes. The kiosk 100 can also select a target setting temperature based on the fabric type, the target setting temperature falling below the target drying temperature and the transition temperature. Therefore, based on the set of garment characteristics, the kiosk 100 can select the set of drying and setting parameters configured to enable the kiosk 100 to: remove moisture from the garment; and cool the garment to a temperature below the transition temperature of the garment to increase the rigidity of the garment fabric and to set the garment in a wrinkle-less state.

Generally, in garments with certain fabric types, the transition temperature can depend on the water saturation of the garment and the temperature of the garment. Thus, the kiosk 100 can select a first transition temperature for a garment characterized by a first water saturation below 1% and a second transition temperature for the garment characterized by a second water saturation in a range between 5%-20%. More specifically, for a first period (e.g., steaming period) of the processing cycle, the kiosk 100 can: select a first target water saturation of the garment; select a first transition temperature associated with the fabric type for the garment saturated to the first target water saturation; and select the target processing temperature exceeding the first transition temperature. Then, for a second period (e.g., drying period) of the processing cycle: the kiosk 100 can select a second target water saturation of the garment, the second target water saturation associated with the dry garment and falling below the first target water saturation; based on the second target water saturation and the target drying temperature, select a second transition temperature associated with the fabric type for the garment saturated to the second target water saturation; and select the target setting temperature falling below the second transition temperature. Therefore, the kiosk 100 can: derive different transition temperatures for the garment for different stages of the processing cycle; and, based on these transition temperatures, select ambient temperatures (e.g., target processing temperature, target drying temperature) of the chamber 102 for different stages of the processing cycle.

7.5 Selecting Target Tension Parameters

In one implementation, based on the set of garment characteristics, the kiosk 100 can select a target tension exerted on the garment by the set of retractable clips 108. More specifically, based on the fabric type, the fabric thickness, and/or the fabric weave type, the kiosk 100 can: derive a target tension of a set of retractable clips 108 attached to the garment, the set of retractable clips 108 configured to tension the garment against a hanger 104; and, in response to detecting closure of a kiosk door 118, retract the set of retractable clips 108 to generate a tension, approximating the target tension, within the garment and release wrinkles within the garment. For example, for garments with coarse fabric types or fabric types that are prone to wrinkling, such as linen, the kiosk 100 can select a higher target tension than for garments with delicate fabric types or fabric types that are wrinkle resistant, such as knit or lace fabrics. Therefore, based on the set of garment characteristics, the kiosk 100 can: select the target tension configured to enable the kiosk 100 to apply tension to the garment via the set of retractable clips 108 to remove wrinkles from the garment.

In one implementation, based on the set of garment characteristics, the kiosk 100 can select a target tension exerted on the garment by the hanger 104, which is configured to translate laterally to tension the garment against the set of retractable clips 108 characterized by a fixed tension. More specifically, the kiosk 100 can: select a target garment tension based on the fabric type; and, based on the target garment tension and the garment dimensions, calculate a lateral displacement of a hanger 104, supporting the garment, associated with the target garment tension. For example, the kiosk 100 can: traverse the hanger 104 rightward by the lateral displacement distance to tension a left sleeve of the garment between the left sleeve retainer 107 and the hanger 104; and traverse the hanger 104 leftward by the lateral displacement distance to tension a right sleeve of the garment between the right sleeve retainer 106 and the camera 104. Generally, larger displacement of the hanger 104 from a central position correlates with a higher tension in the garment. Accordingly, for garments with coarse fabric types or fabric types that are prone to wrinkling, the kiosk 100 can select a longer displacement than for garments with delicate fabric types or fabric types that are wrinkle resistant. Therefore, based on the set of garment characteristics, the kiosk 100 can select the displacement of the hanger 104 correlated with the target tension in the garment, which is configured to facilitate wrinkle removal in the garment.

7.6 Selecting Target Bladder Parameters

In one implementation, based on the set of garment characteristics, the kiosk 100 can select a target pressure exerted by a left bladder and a right bladder on the garment, the left bladder and the right bladder arranged on the hanger 104 and configured to expand into the sleeves or armholes of the garment. More specifically, the kiosk 100 can select the target pressure based on the garment dimensions and the fabric type. Generally, the kiosk 100 can expand the left bladder and the right bladder to: block passage of steam between the interior volume of the garment torso and the interior volumes of the sleeves in a sleeved garment or close openings in a sleeveless garment; and tension the garment proximal the armholes. Accordingly, for garments with coarse fabric types or fabric types that are prone to wrinkling, the kiosk 100 can select a higher pressure than for garments with delicate fabric types or fabric types that are wrinkle-resistant. Therefore, based on the set of garment characteristics, the kiosk 100 can select the target pressure exerted by the left bladder and the right bladder onto the garment, which is configured to facilitate tensioning of the garment against the left bladder and the right bladder and removing wrinkles and creases from the garment. Furthermore, by selecting the target pressure based on the set of garment characteristics, such as the fabric type, the kiosk 100 can avoid excessively stretching the garment by expanding the bladders 121 to a pressure level, exceeding the target pressure, which can introduce permanent changes to the fabric of the garment.

8. Processing Cycle

During the processing cycle, the kiosk can: inflate the set of bladders 121 according to the selected bladder expansion parameters (e.g., target bladder pressure); tension the set of retractable clips 108 according to the selected clip tension parameters (e.g., target clip tension); adjust ambient conditions within the chamber according to the selected target processing temperature and target processing humidity; execute the steam nozzle path according to the set of pressing parameters; clean the garment according to the selected cleaning parameters (e.g., target cleaning liquid volume, cleaning liquid type); dry the garment according to the selected drying parameters (e.g., target drying temperature); and set the garment according to the selected setting parameters (e.g., target setting temperature).

8.1 Bladder Inflation

The kiosk 100 can initiate the processing cycle by selectively inflating the set of bladders 121 to the target pressure in order to close openings within the garment and/or to locally tension the garment. For example, the kiosk 100 can automatically adjust pressure regulators and/or activate a set of valves to inflate: the cuff bladders arranged on the sleeve retainers and currently inserted into cuffs of sleeves of the garment; shoulder bladders arranged on the garment hanger 104 and currently located within shoulders of the garment; and/or a neck bladder 123 arranged on the garment hanger 104 and currently facing the neck of the garment according to setup parameters for the garment.

In one implementation, the kiosk 100 can: inflate the left shoulder bladder 124 to the target pressure, the left shoulder bladder 124 arranged on a hanger 104 supporting the garment, to tension the garment proximal a left armhole of the garment and block passage of steam between interior of a garment torso and interior of a left sleeve; and inflate the right shoulder bladder 122 to the target pressure, the right shoulder bladder 122 arranged on the hanger 104 supporting the garment, to tension the garment proximal a right armhole of the garment and block passage of steam between an interior of garment torso and interior of a right sleeve. In addition, in response to a first pressure within the left shoulder bladder 124 exceeding the target pressure, the kiosk 100 can deflate the left shoulder bladder 124 toward the target pressure. And, in response to a first pressure within the right shoulder bladder 122 exceeding the target pressure, the kiosk 100 can inflate the right shoulder bladder 122 toward the target pressure. Similarly, the kiosk 100 can inflate or deflate the cuff bladders 121 and the neck bladder 123. Therefore, the kiosk 100 can inflate the set of bladders 121 toward the target pressure selected for the garment to tension local areas (e.g., cuffs, sleeves, collar) of the garment, close openings of the garment, and trap steam within the garment, thereby facilitating removal of wrinkles in the garment fabric without permanently stretching or deforming the garment.

8.2 Adjusting Garment Tension

In one implementation, the kiosk 100 can adjust the tension applied by the set of retractable clips 108 to the garment in response to detecting wrinkling or creasing of the garment during the processing cycle. For example, the kiosk 100 can: capture an image of the garment following steaming of the garment; and based on the image, detect wrinkling or creasing of the garment. In response to the wrinkling or creasing of the garment exceeding a threshold, the kiosk 100 can increase the tension applied by the set of retractable clips 108 to the garment and/or trigger additional steaming via the steam nozzle 110.

In this implementation, during the processing cycle, the kiosk 100 can: trigger a camera 140 arranged within the kiosk 100 to capture a first image of the garment; based on first image, detect a set of features of the garment, the set of features representing optical shadows of the garment fabric, which represent wrinkling or creasing of the garment fabric; based on the set of features, detect a wrinkling level of the garment; and, in response to detecting the wrinkling level exceeding a threshold, retract the set of retractable clips 108 to increase the tension within the garment generated by the set of retractable clips 108.

Therefore, by assessing the wrinkling level of the garment during the processing cycle, the kiosk 100 can identify garments that remain wrinkled after application of steam via the steam nozzle 110 and/or after tensioning of the garment via the set of retractable clips 108 and the set of bladders 121. In response to detecting the wrinkling level exceeding a threshold, the kiosk 100 can dynamically adjust garment processing parameters during the processing cycle, such as by increasing the target clip tension, the target steaming duration, the target steam temperature, the target processing temperature, or the target processing humidity to decrease the wrinkling level in the garment.

8.3 Setting Ambient Chamber Conditions

Blocks S150 and S152 of the method S100 recite, during a first time period of the processing cycle: heating air within the chamber 102 toward the target processing temperature; and injecting steam into the chamber 102 to drive a humidity within the chamber 102 toward the target processing humidity. In Blocks S150 and S152, the kiosk 100 can increase the ambient temperature within the chamber 102 toward the target processing temperature and increase the ambient humidity within the chamber 102 toward the target processing humidity during the first time period following the closure of the kiosk door 118 and preceding articulation of the steam nozzle 110. Generally, the kiosk 100 can increase the ambient temperature and the ambient humidity by releasing steam into the chamber 102 through the steam nozzle 110 and/or by supplying heated air to the chamber 102 via the hot dryer 130 and the set of dryer nozzles 112. By elevating the ambient chamber conditions to the target processing temperature and increasing the ambient humidity, the kiosk 100 can increase the garment temperature above the transition temperature and increase the moisture content of the garment toward the target water saturation associated with the transition temperature, which decreases the rigidity of the garment fabric and facilitates wrinkle-release in the garment.

In one example, the kiosk 100 can activate the hot dryer 130 to preheat the chamber 102 and the garment to a target chamber temperature specified by the setup parameters, such as while activating the steam generator 114 to generate steam. Additionally, or alternatively, the kiosk 100 can set a ventilation condition—such as in preparation to ingest fresh air and exhaust moist air or to recirculate moist air in the chamber 102 following activation of the steam nozzle 110—according to the setup parameters.

8.4 Applying Cleaning Liquid

In one implementation, during the processing cycle and after increasing the ambient conditions within the chamber 102 toward the target processing temperature and the target processing humidity, the kiosk 100 can: trigger a cleaning liquid nozzle to expel the target cleaning liquid volume of the first cleaning liquid type toward the garment, the target cleaning liquid volume and the first cleaning liquid type selected for the garment based on the set of garment characteristics. Therefore, the kiosk 100 can: apply the target cleaning liquid volume of the first cleaning liquid type to the garment during the processing cycle to clean and deodorize the garment while minimizing chemical damage to the garment.

8.5 Applying Steam to the Garment

Blocks S162 and S164 of the method S100 recites, during a second time period succeeding the first time period: articulating a steam nozzle 110 along the steam nozzle path at the steam nozzle speed to impinge a steam jet across an interior surface of the garment, tension local areas of the garment against the steam jet, and heat local areas of the garment above the transition temperature; and, in response to the humidity within the chamber 102 exceeding the target processing humidity, evacuating humidified air from the chamber 102. In Block S162 and S164, the kiosk 100 can steam local areas of the garment by articulating the steam nozzle 110 through the steam nozzle path at the steam nozzle speed during a time period following elevating the ambient chamber conditions to the target processing temperature and increase the ambient humidity. By thus steaming the local areas of the garment, the kiosk 100 can further increase the garment temperature above the transition temperature of the garment tension local areas of the garment with steam, thereby further decreasing the rigidity of the garment fabric and facilitating wrinkle-release in the garment.

In one implementation, kiosk 100 can then execute a processing cycle to steam the garment by opening the steam valve and triggering the multi-axis stage to sweep the steam nozzle 110 along a path and at a speed calculated based on or prescribed by the processing model.

During this processing cycle, the kiosk 100 can also: monitor temperature and humidity conditions within the chamber 102 via temperature and humidity sensors arranged in the chamber 102; and implement closed-loop controls to selectively activate the hot dryer 130 and cold dryer 132 (e.g., directed away from the garment) and selectively open the chamber 102 vent to maintain chamber conditions specified in the processing parameters.

In one implementation, the kiosk 100 can: select a set of steam-processing parameters including a target steam temperature and a target steaming duration based on the set of garment characteristics; heat steam in a steam generator 114 toward the target steam temperature; and trigger the steam nozzle 110 to expel steam over the target steaming duration to impinge a steam jet across an interior surface of the garment, tension local areas of the garment against the steam jet, and heat local areas of the garment. Therefore, the kiosk 100 can steam the garment at the target steam temperature over the target steaming duration, selected specifically for the garment, to facilitate wrinkle-release in the garment while avoiding oversaturation of the garment with steam, which can increase the garment drying duration, and avoiding exposing the garment to steam temperatures, exceeding the target steam temperature, which can damage the garment.

8.6 Drying

Block S170 of the method S100 recites: during a second time period succeeding the first time period, actuating a hot dryer 130 to supply hot air toward the garment to drive chamber temperature toward the target drying temperature. Generally, in Block S170, upon completion of the steam nozzle path, the kiosk 100 can trigger the hot dryer 130 to direct hot air toward the garment to drive the chamber temperature toward the target chamber temperature. By propelling hot air into the chamber 102 and toward the garment, the kiosk 100 can: decrease ambient humidity within the chamber 102 by diluting the moist air within the chamber 102 with hot, dry air; and facilitate evaporation of moisture from the garment. Therefore, by triggering the hot dryer 130 to propel hot air toward the garment, the kiosk 100 can facilitate removal of moisture from the garment, thereby drying the garment and preparing the garment for handling by the user immediately following completion of the drying cycle.

In one implementation, upon completion of the steam nozzle path, the kiosk 100 can trigger opening of a ventilation duct or an exhaust 116 to vent moist air from the chamber 102. In one example, the kiosk 100 can trigger opening of the ventilation duct or the exhaust 116 prior to activation of the dryers to decrease ambient humidity within the chamber 102 prior to initiating drying. Additionally, or alternatively, following completion of the steam nozzle path, the kiosk 100 can activate an exhaust fan to remove moist air from the chamber 102 and expel the moist air outside the kiosk 100. In one example, the kiosk 100 can activate the exhaust fan while simultaneously triggering the hot dryer 130 to supply hot air into the chamber 102. Therefore, during a drying period the processing cycle, kiosk 100 can actively or passively remove moist air from the chamber 102 to facilitate drying of the garment and to shorten a drying duration of the garment.

In one implementation, the kiosk 100 can then set positions of and selectively activate and articulate the hot dryer 130 and/or cold dryer 132 to dry the garment according to processing parameters calculated or predefined for the garment in the processing model.

For example, for a robust, well-constrained garment of a fabric characterized by a high transition temperature (e.g., a long-sleeved, high-necked polyester shirt), the kiosk 100 can activate and direct the hot dryer 130 toward the garment—according to the processing parameters—in order to rapidly dry the garment. Conversely, for a less robust, loosely-constrained garment of a fabric characterized by a low transition temperature (e.g., a sleeveless, low-necked silk shirt), the kiosk 100 can activate and direct the cold dryer 132 away from the garment—according to the processing parameters—in order to slowly dry the garment with low risk of damage to or re-wrinkling the garment.

8.7 Cooling and Wrinkle Setting

Block S172 of the method S100 recites: during a third time period succeeding the second time period, actuating the cold dryer 132 to propel cold air toward the garment to drive chamber temperature toward the setting temperature. Generally, in Block S172, upon completion of the drying period of the processing cycle, the kiosk 100 can trigger the cold dryer 132 to propel cold air toward the garment to drive the chamber temperature toward the setting temperature and to drive the garment temperature below the transition temperature of the garment. In one example, the setting temperature can correspond to a temperature less than the transition temperature of the garment. By driving the chamber temperature toward the setting temperature, the kiosk 100 can facilitate a transition of the garment fabric from a malleable state to a rigid state ensuring that the garment will remain unwrinkled over a period of time, such as a day or a week, following processing at the kiosk 100. Therefore, by driving the chamber temperature toward the setting temperature, the kiosk 100 can set the garment in a lasting unwrinkled state.

In one implementation, the kiosk 100 activates and sets the cold dryer 132 to face away from the garment to circulate air within the kiosk 100 and thus cool the garment based on the processing parameters, thereby setting the garment in a wrinkle-free state. In particular, by orienting the cold dryer 132 to face away from the garment, the kiosk 100 can avoid disturbing or unsettling the garment before it has fully cooled to below the crystallization temp of its fabric and thus avoid creating new wrinkles in the garment.

In this implementation, the kiosk 100 can also reset ventilation in the chamber to exhaust moisture from the chamber.

Upon drying the garment, the kiosk 100 can unlock the door 118 and prompt the user to retrieve the garment from the kiosk 100, thereby completing the processing cycle.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

We claim:

1. A method comprising:

accessing a set of garment characteristics of a garment arranged within a chamber of a kiosk, the set of garment characteristics comprising a fabric type, a garment type, and a garment dimension;

selecting a target processing humidity associated with the fabric type;

selecting a target processing temperature exceeding a transition temperature associated with the fabric type;

based on the set of garment characteristics, selecting a set of steam-processing parameters comprising:
a steam nozzle path; and
a steam nozzle speed;
during a processing cycle:
during a first time period:
heating air within the chamber toward the target processing temperature;
injecting steam into the chamber to drive a humidity within the chamber toward the target processing humidity;
during a second time period succeeding the first time period:
articulating a steam nozzle, arranged within the kiosk, along the steam nozzle path at the steam nozzle speed to:
impinge a steam jet across an interior surface of the garment;
tension local areas of the garment against the steam jet; and
heat local areas of the garment above the transition temperature; and
in response to the humidity within the chamber exceeding the target processing humidity, evacuating humidified air from the chamber.

2. The method of claim 1:
wherein accessing the set of garment characteristics the garment comprises:
accessing the fabric type comprising cotton;
wherein selecting the target processing humidity comprises:
accessing a first target water saturation of the garment within a first range between 5% and 10% based on the fabric type of the garment; and
calculating the target processing humidity predicted to yield the first target water saturation within the garment resulting from application of the steam jet across the interior surface of the garment according to the set of steam-processing parameters;
wherein selecting the target processing temperature comprises:
accessing the transition temperature, of the fabric type of the garment, in a second range between 50 degrees Celsius and 60 degrees Celsius;
selecting the target processing temperature exceeding the transition temperature in a third range between 60 degrees Celsius and 70 degrees Celsius; and
further comprising:
accessing a second set of garment characteristics of a second garment arranged within the chamber, the second set of garment characteristics comprising a second fabric type comprising silk;
based on the second set of garment characteristics, accessing a second set of steam-processing parameters;
accessing a second target water saturation of the garment within the first range between 5% and 10% based on the second fabric type of the second garment;
calculating a second target chamber humidity predicted to yield the second target water saturation within the garment resulting from application of the steam jet across the interior surface of the garment according to the set of steam-processing parameters;
accessing a second transition temperature of the second fabric type of the second garment, in a fourth range between 40 degrees Celsius and 50 degrees Celsius; and
selecting the target processing temperature exceeding the transition temperature in the second range between 50 degrees Celsius and 60 degrees Celsius.

3. The method of claim 1:
further comprising:
accessing a target drying duration for the garment;
deriving a target water saturation of the fabric type, the target water saturation inversely proportional to the target drying duration; and
accessing the transition temperature associated with the fabric type saturated with moisture at the target water saturation;
wherein selecting the target processing humidity comprises:
selecting the target processing humidity predicted to yield the target water saturation in the garment;
wherein injecting steam into the chamber comprises:
injecting steam into the chamber to drive a moisture content of the garment toward the target water saturation; and
further comprising:
a third time period succeeding the second time period:
actuating a hot dryer over the target drying duration to direct hot air toward the garment.

4. The method of claim 1:
wherein selecting the set of steam-processing parameters comprises:
loading the steam nozzle path comprising a predefined steam nozzle path;
based on the garment dimension, estimating a distance from the steam nozzle to the interior surface of the garment;
calculating the steam nozzle speed inversely proportional to the distance;
accessing a nominal steam temperature of steam expelled from the steam nozzle; and
accessing a nominal steam flow rate of steam expelled from the steam nozzle; and
wherein articulating the steam nozzle along the steam nozzle path at the steam nozzle speed comprises:
heating steam toward the nominal steam temperature; and
articulating the steam nozzle along the steam nozzle path at the steam nozzle speed to expel the steam jet, characterized by the nominal steam flow rate and the nominal steam temperature, toward the interior surface of the garment.

5. The method of claim 1:
wherein selecting the set of steam-processing parameters comprises:
accessing target steam jet energy based on the fabric type;
based on the garment dimension, estimating a distance from the steam nozzle to the interior surface of the garment;
calculating a stepover distance between legs of the steam nozzle path, the stepover distance inversely proportional to the distance;
deriving the steam nozzle path characterized by the stepover distance; and
based on the steam nozzle path, calculating the steam nozzle speed, a steam temperature, and a steam flow rate predicted to yield an estimated energy of the steam jet, impinging on the interior surface of the garment, that approximates the target steam jet energy; and wherein articulating the steam nozzle along the steam nozzle path at the steam nozzle speed comprises:

articulating the steam nozzle along the steam nozzle path at the steam nozzle speed to expel the steam jet, characterized by the steam flow rate and the steam temperature, toward the interior surface of the garment.

6. The method of claim 1, further comprising:

based on the set of garment characteristics, selecting a target drying temperature;

based on the fabric type, selecting a target setting temperature less than the target drying temperature and the transition temperature; and during the processing cycle:

during a third time period succeeding the second time period:

actuating a hot dryer to:

direct hot air toward the garment; and drive a chamber temperature of the chamber toward the target drying temperature; and during a fourth time period succeeding the third time period:

actuating a cold dryer to:

direct cold air toward the garment; and drive the chamber temperature toward the target setting temperature to set the garment in an unwrinkled state.

7. The method of claim 1:

wherein accessing the set of garment characteristics of the garment comprises:

presenting a set of fabric types on a user interface arranged on the kiosk;

prompting a user to select the fabric type of the garment from the set of fabric types;

prompting the user to indicate a first percent composition of the fabric type in the garment; and in response to the first percent composition falling below one hundred percent:

prompting the user to select a second fabric type of the garment from the set of fabric types; and prompting the user to input a second percent composition of the second fabric type in the garment; and wherein selecting the target processing temperature comprises:

based on the first percent composition of the first fabric type and the second percent composition of the second fabric type, selecting the target processing temperature.

8. The method of claim 1, wherein accessing the set of garment characteristics of the garment comprises:

at a first time:

prompting a user to load the garment into the kiosk;

triggering a camera arranged within the kiosk to capture a first image of the garment; and detecting a set of features of the garment in the first image;

matching the set of features to a template, in a set of templates, associated with the garment type; and in response to matching the set of features to the template, identifying the garment type of the garment; and at a second time:

in response to closure of a kiosk door:

locking the kiosk door; and triggering the camera to capture a second image of the garment; and based on the second image, detecting the garment dimension.

9. The method of claim 8, further comprising:

at the first time:

in response to identifying the garment type, selecting a target clip-attachment geometry based on the garment type; and prompting the user to arrange a set of retractable clips, located within the chamber, on the garment according to the target clip-attachment geometry to tension the garment.

10. The method of claim 8, wherein detecting the garment dimension comprises:

detecting a set of edge features corresponding to the garment in the second image;

based on the set of edge features, interpreting a perimeter of a torso section of the garment;

detecting a pixel count of an area of the second image bound by the perimeter; and calculating the garment dimension comprising a surface area of the torso section of the garment based on the pixel count.

11. The method of claim 1, further comprising:

based on the fabric type, selecting a first cleaning liquid, from in a set of cleaning liquids, for application on the garment during the processing cycle;

calculating a target cleaning liquid volume of the first cleaning liquid, for application on the garment during the processing cycle, based on the garment dimension; and during the processing cycle:

during a third time period succeeding the first time period and preceding the second time period, triggering a cleaning liquid nozzle to expel the target cleaning liquid volume of the first cleaning liquid toward the garment.

12. The method of claim 1:

wherein accessing the set of garment characteristics of the garment comprises:

accessing the set of garment characteristics further comprising a fabric thickness;

wherein selecting the target processing humidity comprises:

selecting the target processing humidity correlated with the fabric thickness; and wherein selecting the set of steam-processing parameters comprises:

selecting a target steam jet pressure correlated with the fabric thickness.

13. The method of claim 1, further comprising:

based on the fabric type, deriving a target tension exerted by a set of retractable clips attached within the garment; and in response to detecting closure of a kiosk door, retracting the set of retractable clips to:

generate a tension, approximating the target tension, within the garment; and release wrinkles within the garment.

14. The method of claim 1, further comprising:
during the processing cycle:
during a third time period succeeding the second time period:
triggering a camera arranged within the kiosk to capture a first image of the garment;
based on the first image, detecting a set of features of the garment, the set of features representing shadows on the garment;
based on the set of features, detecting a wrinkling level of the garment; and
in response to detecting the wrinkling level exceeding a threshold, retracting a set of retractable clips to:
increase a tension within the garment generated by the set of retractable clips; and
release wrinkles within the garment.

15. The method of claim 1, further comprising:
based on the garment dimension and the fabric type, selecting a target pressure exerted by a left shoulder bladder and a right shoulder bladder onto the garment;
during the processing cycle:
during a third time period preceding the first time period:
inflating the left shoulder bladder to the target pressure, the left shoulder bladder arranged on a hanger supporting the garment, to:
tension the garment proximal a left armhole of the garment;
block passage of steam between interior of a garment torso and interior of a left sleeve; and
inflating the right shoulder bladder to the target pressure, the right shoulder bladder arranged on the hanger supporting the garment, to:
tension the garment proximal a right armhole of the garment; and
block passage of steam between interior of the garment torso and interior of a right sleeve;
in response to a first pressure within the left shoulder bladder exceeding the target pressure, deflating the left shoulder bladder toward the target pressure; and
in response to a second pressure within the right shoulder bladder exceeding the target pressure, deflating the right shoulder bladder toward the target pressure.

16. The method of claim 1, further comprising:
based on the fabric type, selecting a target garment tension;
based on the target garment tension and the garment dimension, calculating a lateral displacement distance of a hanger, supporting the garment, associated with the target garment tension; and
during the processing cycle:
traversing the hanger rightward by the lateral displacement distance to tension a left sleeve of the garment between a left sleeve retainer and the hanger; and
traversing the hanger leftward by the lateral displacement distance to tension a right sleeve of the garment between a right sleeve retainer and the hanger.

17. A method for autonomously processing a garment within a kiosk comprising:
accessing a set of garment characteristics of the garment, the set of garment characteristics comprising a fabric type, a garment type, and a garment dimension;
selecting a target processing humidity associated with the fabric type;
selecting a target processing temperature exceeding a transition temperature associated with the fabric type;
based on the fabric type, selecting a target drying temperature;
based on the fabric type, selecting a target setting temperature below the target drying temperature and the transition temperature; and
during a processing cycle:
during a first time period:
heating air within a chamber toward the target processing temperature; and
injecting steam into the chamber to:
drive a humidity within the chamber toward the target processing humidity; and
heat local areas of the garment above the transition temperature associated with the fabric type of the garment;
during a second time period succeeding the first time period, actuating a hot dryer to propel hot air toward the garment to drive a chamber temperature toward the target drying temperature; and
during a third time period succeeding the second time period, actuating a cold dryer to propel cold air toward the garment to drive the chamber temperature toward the target setting temperature.

18. The method of claim 17:
further comprising:
selecting a target drying duration for the garment;
deriving a target water saturation of the fabric type, the target water saturation inversely proportional to the target drying duration; and
selecting a first target water saturation of the garment correlated with the target drying duration;
wherein selecting the target processing humidity comprises:
selecting the target processing humidity configured to yield the target water saturation of the garment;
wherein selecting the target processing temperature comprises:
accessing the transition temperature comprising a first transition temperature associated with the fabric type saturated with moisture at the target water saturation; and
selecting the target processing temperature exceeding the first transition temperature; and
further comprising:
selecting a second target water saturation of the garment, the second target water saturation falling below the first target water saturation; and
accessing a second transition temperature associated with the fabric type saturated with moisture at the second target water saturation;
wherein selecting the target setting temperature comprises:
selecting the target setting temperature falling below the second transition temperature;
wherein injecting steam into the chamber comprises:
injecting steam into the chamber to drive a moisture content of the garment toward the first target water saturation;
wherein actuating the hot dryer to propel hot air toward the garment comprises:
actuating the hot dryer to propel hot air toward the garment over the target drying duration to drive the moisture content of the garment toward the second target water saturation; and wherein actuating the cold dryer to propel cold air toward the garment comprises:

actuating the cold dryer to propel cold air toward the garment to drive the chamber temperature toward the target setting temperature below the second transition temperature.

19. The method of claim 17, further comprising:

based on the set of garment characteristics, selecting a set of steam-processing parameters comprising:

a steam nozzle path;

a steam nozzle speed; and during a fourth time period succeeding the first time period and preceding the second time period:

articulating a steam nozzle along the steam nozzle path at the steam nozzle speed to:

impinge a steam jet across an interior surface of the garment;

tension local areas of the garment against the steam jet; and heat local areas of the garment above the transition temperature.

20. A method for autonomously processing a garment within a kiosk comprising:

accessing a set of garment characteristics of the garment arranged within a chamber of the kiosk, the set of garment characteristics comprising a fabric type, a garment type, and a garment dimension;

based on the set of garment characteristics:

selecting a target processing humidity; and selecting a target processing temperature;

based on the set of garment characteristics, selecting a set of steam-processing parameters comprising:

a target steam temperature; and a target steaming duration;

during a processing cycle:

during a first time period:

heating air within the chamber toward the target processing temperature; and injecting steam into the chamber to drive a humidity within the chamber toward the target processing humidity; and during a second time period succeeding the first time period:

heating steam in a steam generator toward the target steam temperature;

triggering a steam nozzle to expel steam over the target steaming duration to:

impinge a steam jet across an interior surface of the garment; and tension local areas of the garment against the steam jet.

* * * * *